US009346157B2

(12) United States Patent
Morioka et al.

(10) Patent No.: US 9,346,157 B2
(45) Date of Patent: May 24, 2016

(54) DRIVING TOOLS

(71) Applicants: Yasuhiro Morioka, Anjo (JP); Noriyuki Nishido, Anjo (JP)

(72) Inventors: Yasuhiro Morioka, Anjo (JP); Noriyuki Nishido, Anjo (JP)

(73) Assignee: MAKITA CORPORATION, Anjo (JP)

( * ) Notice: Subject to any disclaimer, the term of this patent is extended or adjusted under 35 U.S.C. 154(b) by 667 days.

(21) Appl. No.: 13/684,831

(22) Filed: Nov. 26, 2012

(65) Prior Publication Data

US 2013/0134204 A1 May 30, 2013

(30) Foreign Application Priority Data

Nov. 30, 2011 (JP) ..... 2011-261556

(51) Int. Cl.

| | |
|---|---|
| ***B25C 5/02*** | (2006.01) |
| ***B25C 5/06*** | (2006.01) |
| ***B25C 1/00*** | (2006.01) |
| ***B25D 1/08*** | (2006.01) |
| ***B25C 5/16*** | (2006.01) |

(52) U.S. Cl.

CPC ..... *B25C 1/003* (2013.01); *B25C 1/005* (2013.01); *B25C 5/1617* (2013.01); *B25D 1/08* (2013.01)

(58) Field of Classification Search

CPC ..... B25C 1/003; B25C 1/08

USPC ..... 227/9, 114–115, 119–139

See application file for complete search history.

(56) References Cited

U.S. PATENT DOCUMENTS

| | | | | |
|---|---|---|---|---|
| 4,129,240 | A * | 12/1978 | Geist | 227/8 |
| 4,651,912 | A | 3/1987 | Hawkins | |
| 5,881,940 | A * | 3/1999 | Almeras | B25C 1/14 227/10 |
| 5,934,162 | A * | 8/1999 | Habermehl | B25B 23/045 227/136 |
| 5,947,362 | A * | 9/1999 | Omli | B25C 5/1693 227/120 |
| 5,996,874 | A * | 12/1999 | Fukushima | B25B 21/023 173/104 |
| 6,123,243 | A * | 9/2000 | Pfister | B25C 1/14 173/211 |
| 6,647,836 | B1 * | 11/2003 | Habermehl | B25B 23/045 173/107 |
| 6,708,860 | B1 * | 3/2004 | Thieleke | 227/8 |
| 6,845,693 | B1 * | 1/2005 | Babij, Jr. | B25B 23/04 81/434 |
| 6,966,476 | B2 * | 11/2005 | Jalbert et al. | 227/8 |
| 7,140,524 | B2 * | 11/2006 | Hung et al. | 227/8 |
| 7,410,084 | B1 * | 8/2008 | Reed | B25C 1/00 173/202 |
| 7,506,788 | B2 * | 3/2009 | Liang et al. | 227/133 |
| 7,575,142 | B2 * | 8/2009 | Liang et al. | 227/133 |

(Continued)

FOREIGN PATENT DOCUMENTS

| | | |
|---|---|---|
| EP | 2 301 718 A2 | 3/2011 |
| GB | 1 386 810 | 3/1975 |

(Continued)

OTHER PUBLICATIONS

Mar. 3, 2015 Office Action issued in Japanese Application No. 2011-261556.

(Continued)

*Primary Examiner* — Robert Long
(74) *Attorney, Agent, or Firm* — Oliff PLC

(57) ABSTRACT

A driving tool may include a driven member holding mechanism configured to hold the driven member at a driving position inside a driver guide until a driver drives the driven member.

8 Claims, 17 Drawing Sheets

(56) References Cited

U.S. PATENT DOCUMENTS

| | | | | |
|---|---|---|---|---|
| 2002/0053587 | A1* | 5/2002 | White | B25C 1/003 227/131 |
| 2003/0218044 | A1* | 11/2003 | Laubach et al. | 227/109 |
| 2005/0001007 | A1* | 1/2005 | Butzen | B25C 1/005 227/130 |
| 2005/0126345 | A1* | 6/2005 | Berthiaume | B25C 9/00 81/44 |
| 2007/0215665 | A1* | 9/2007 | Ohmori | B25C 1/047 227/8 |
| 2007/0290019 | A1* | 12/2007 | Tille | B25C 1/005 227/10 |
| 2008/0179372 | A1* | 7/2008 | Kurth et al. | 227/136 |
| 2010/0213233 | A1* | 8/2010 | Liu | B25C 7/00 227/120 |
| 2011/0057014 | A1* | 3/2011 | Yang et al. | 227/8 |
| 2011/0062207 | A1* | 3/2011 | Hlinka et al. | 227/8 |
| 2011/0062208 | A1* | 3/2011 | Hlinka et al. | 227/8 |
| 2011/0073630 | A1* | 3/2011 | Kakuda et al. | 227/8 |
| 2011/0108299 | A1* | 5/2011 | Wei | B25D 11/068 173/122 |
| 2011/0132959 | A1* | 6/2011 | Hlinka et al. | 227/8 |
| 2011/0240709 | A1* | 10/2011 | Oouchi | 227/8 |
| 2011/0259938 | A1* | 10/2011 | Chien | B25C 1/06 227/129 |

FOREIGN PATENT DOCUMENTS

| | | |
|---|---|---|
| JP | A-11-179678 | 7/1999 |
| JP | 2002-283249 A | 10/2002 |
| JP | B2-3520754 | 4/2004 |
| JP | 2007-320029 A | 12/2007 |
| JP | B2-4047998 | 2/2008 |

OTHER PUBLICATIONS

Jul. 15, 2013 extended European Search Report issued in European Patent Application No. EP 12 19 4605.7.

* cited by examiner

DRIVING TOOLS

This application claims priority to Japanese patent application serial number 2011-261556, the contents of which are incorporated herein by reference.

BACKGROUND OF THE INVENTION

1. Field of the Invention

Embodiments of the present invention relate to driving tools used for driving driven members such as nails and having driver guides. Such driver guides can be used to direct driven and driven members used by tools.

2. Description of the Related Art

A nailing machine is a known tool configured to drive driven members, such as nails, into an object. Such a nailing machine is equipped with a magazine that can be loaded with a plurality of nails. The plurality of nails may be bundled together in an appropriate number (for example, ten) by a strap-like connection member formed by the molding of an appropriate resin. The nails thus bundled up may be pushed out by a driver, whereby the connection resin strip is broken between the first nail to be driven and the second nail. The second nail is positioned next to the first nail. This enables the nail to be driven into the object (see JP-A-11-179678 also published as U.S. Pat. No. 3,520,754 and JP-A-2000-158360 also published as U.S. Pat. No. 4,047,988).

In the following description, nails thus bundled together by a connection resin strip will be referred to as a "nail bundle"; a nail driven into an object will be referred to as a "driven nail"; and a final nail remaining after the successive driving of nails from the nail bundle will be referred as a "last nail."

In this kind of nailing machine, in accordance with legislative safety measures, the ejection end of the driver guide is formed as a contact top, so that nails can be driven only when the contact top is pressed against an object. More specifically, when the contact top is pressed against the object, the driver guide moves toward the base end side (that is, the side of the nailing machine main body), so that the contact top can be detected as being pressed against the object. In this way, the nail driving operation is possible only when the contact top is being pressed against the object.

On the other hand, each nail of the nail bundle loaded in the interior of the driver guide may be supported by the nail bundle via the above-mentioned bundle resin strip except when it is the last nail. That is, the bundled nail loaded into the driver guide is supported by the inter-nail support via the bundle resin strip, whereby the driven nail can be supported while being set in position at the correct driving position inside the driver guide.

A structure is capable of detecting the contact state of the nails in order to adjust the position of the driver guide. When one final nail remains, such nail cannot be supported by the internal support of the bundle strip. In this situation, the driver guide is often not place in its correct position. Resultantly, problems often occur with the final nail. It may not be placed in the correct position or it may get driven along with the nail positioned before it.

Thus, when the driver guide moves due to the structure capable of detecting the in-contact state of the driver guide, the last nail, which cannot be supported through the inter-nail support via the bundle resin strip, is deviated from the correct driving position in the driver guide as a result of this movement, with the result that the last nail may be get out of a driving course or may be driven together with the next nail.

Therefore, there has been a need in the art for a technique enabling the last nail of the bundle resin strip to be correctly positioned at a driving position.

SUMMARY OF THE INVENTION

In one aspect according to the present teachings, a driving tool may include a driven member holding mechanism configured to hold the driven member at a driving position inside a driver guide until a driver drives the driven member.

BRIEF DESCRIPTION OF THE DRAWINGS

FIGS. 8A and 8B are diagrams illustrating a second embodiment, of which FIG. 8A is a side view of a driver guide at an initial stage, and FIG. 8B is a front view of a shooting port;

DETAILED DESCRIPTION OF THE INVENTION

Figure 1:
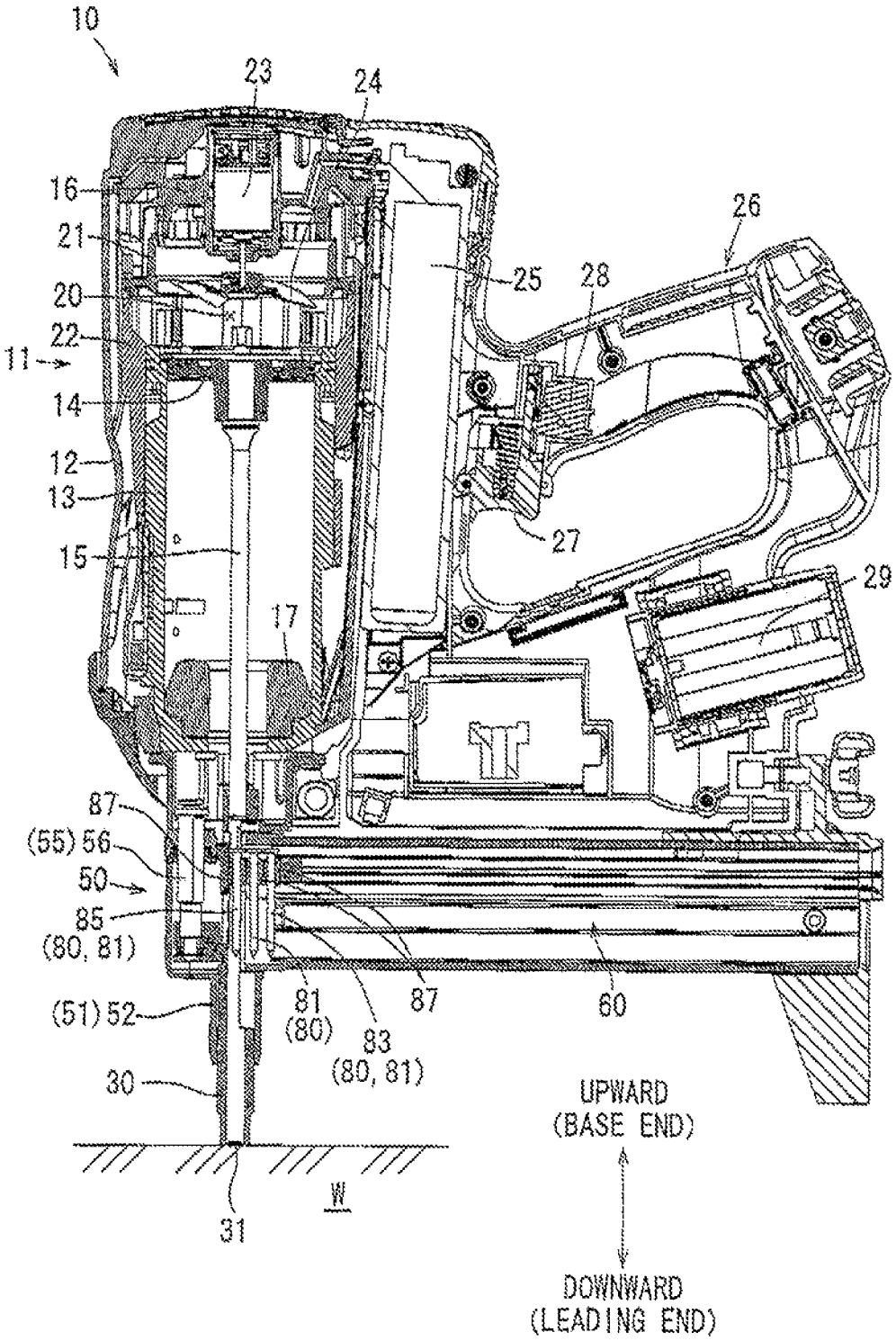
FIG. 1 is a sectional view of a combustion type driving tool, the interior of which is visible.

Each of the additional features and teachings disclosed above and below may be utilized separately or in conjunction with other features and teachings to provide improved driving tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one embodiment, a driving tool may include a tool body, a driver configured to drive a driven member, such as a nail, a driver guide movable with respect to the tool body and configured to guide the driver together with the driven member, and a driven member holding mechanism configured to hold the driven member at a driving position inside the driver guide until the driven member is driven by the driver and such holding of the driven member occurring independently of the movement of the driver guide with respect to the tool body.

In this way, the driver guide is configured as a movable driver guide capable of moving with respect to the driving tool main body. Therefore, when an ejection end of the driver guide is brought into press contact with an object, into which the driven member is driven, the driver guide is moved with respect to the driving tool main body, making it possible to detect this press-contact state. The driven member holding mechanism may hold the driven member at a driving position inside the driver guide until the driven member is driven by the driver and such holding of the driven member occurring independently of the movement of the driver guide with respect to the tool body As a result, should the driver guide move toward the base end side stroke end, i.e., the side of the driving tool main body, with the ejection end of the driver guide being pressed against the object of driving, it is possible to support the last driven member (e.g., the last nail) in position at the correct driving position inside the driver guide by the driven member holding mechanism.

The driven member holding mechanism may include an internally exposed member exposed inside the driver guide. The internally exposed member may be a separate member from the driver guide and may not move in conjunction with the movement of the driver guide with respect to the tool body. The internally exposed member may include a pressing surface against which the driven member is pressed by a feeding force that feeds the driven member toward the driving position. The driven member pressed against the pressing surface may be held at the driving position until the driven member is driven by the driver independently of the movement of the driver guide with respect to the tool body.

With this arrangement, the feeding force may press the driven member against the pressing surface of the internally exposed member. Therefore, even when the driver guide moves from the stroke end on the side of the leading end (ejecting side) toward the stroke end on the side of the base end, i.e., the side of the tool main body, it is possible to press the last driven member (e.g., the last nail) against the pressing surface and support the last driven member in position at the correct driving position inside the driver guide.

The driver guide may have an opening through which the pressing surface is exposed to inside of the driver guide. Therefore, the pressing surface of the internally exposed member can be exposed inside of the driver guide by simply forming the opening in the driver guide. Hence, it is possible to simplify the production of products incorporating embodiments of this invention.

A plurality of driven members may be bundled together by a bundle resin strip, so that the bundle resin strip covers the outer circumferential surfaces of the driven members. The driven member may be pressed against the pressing surface via the bundle resin strip.

Therefore, it is easier to produce a fictional force against the driven member by pressing the driven member. This may be advantageous in supporting the last driven member (e.g., the last nail) at a determined position.

In place of the internally exposed member, the driven member holding mechanism may include an engaging mechanism having an engaging member movable into and out of a driving passage in the driver guide. When the driver is moved to drive the driven member, the engaging member is positioned out of the driving passage. When the driver is not moved to drive the driven member, the engaging member is positioned within the driving passage to engage the driven member.

In this way, when the driver guide moves from the stroke end on the side of the leading and toward the side of the base end, i.e., the side of the tool main body, the engaging member may engage the driven member, making it possible to support the last driven member (e.g., the last nail) at the correct driving position inside the driver guide. At the time of driving, the engaging member may retract so as to secure the driving path Inside the driver guide, so that the driver can drive the driven member without being interfered by the engaging member.

In the case that a plurality of driven members are bundled together by a bundle resin strip, the engaging member may include a claw member configured to engage the bundle resin strip. The claw member may protrude into the driving path to engage the bundle resin strip. The claw member is used for holding the driven member at the driving position. The claw member may retract from the driving path to release the bundle resin strip when driving the driven member by the driver. Therefore, it is easier to engage the driven member by the claw member. This may be advantageous in supporting the last driven member (e.g., the last nail) at a determined position.

The driver guide may have an and portion configured as a contact top for contacting an object into which the driven member is driven. The driver guide may move with respect to the tool body as the contact top is pressed against the object. Therefore, the driver guide can be used for determining whether or not the leading end of the driver guide is being pressed against the object, thereby achieving a reduction in the number of components.

The driving tool may be a combustion-type driving tool having a combustion chamber provided in the tool body. The combustion chamber may be closed in response to the pressing movement of the contact top against the object.

In the following, a driving tool according to a frat embodiment will be described with reference to the drawings. FIG. 1 is a sectional view of a combustion-type driving tool 10 showing the interior of the combustion-type driving tool 10. In the following description, the upper side, lower side, etc. are determined based on the position shown in FIG. 1, in order to enable easy understanding of the construction of the elements of the combustion-type driving tool 10. That is, in general, the combustion-type driving tool 10 may be configured to drive nails 80 as driven members in a direction vertically downwards. Therefore, the sides of the combustion-type driving tool 10 such as the upper and lower sides may be determined in view of this generally adopted driving direction. Regarding such members as a driver 15 and a driver guide 30, the side toward which a driven nail 85 is ejected may be referred to as the leading end side, and the side opposite the ejecting side may be referred to as the base end side. Symbol W in FIG. 1 indicates a workpiece serving as an object into which nails are driven.

The combustion type-driving tool 10 shown in FIG. 1 drives in the driven nail 85 (nails 80) as the driven member. For this purpose, the combustion-type driving tool 10 may be equipped with the driver 15 for driving the driven nail 85, and may be also equipped with the driver guide 30 for guiding this driver 15. That is, the combustion-type driving tool 10 may be generally equipped with a tool main body 11, the driver guide 30, and a magazine 60. The tool main body 11 may serve to generate a driving force for driving the driven nail 85.

As shown in FIG. 1, the tool main body 11 may be provided with a cylinder 13 within a main body case 12. A piston 14 capable of reciprocating may be accommodated within the cylinder 13 so as to be. A damper 17, functioning as a stopper for limiting the downward movement of the piston 14, may be mounted to the lower portion of the cylinder 13. The driver 15 for driving the driven member may be mounted at the center of the lower surface of the piston 14. The driver 15 may be formed as an elongated metal rod. The leading and side portion of this driver 15 may extend into the driver guide 30 via the inner peripheral side of the damper 17. A combustion chamber 20 may be defined between the piston 14 and a cylinder head 16. The combustion chamber 20 may be opened and closed through vertical movement of a cylindrical combustion chamber valve 21. This combustion chamber valve 21 may be mounted integrally with the upper portion of a chamber wall 22 and may extend along the upper portion. The chamber wall 22 may be formed in a substantially cylindrical configuration, and may be supported so as to be vertically movable along the outer peripheral side of the cylinder 13. In the state shown in FIG. 1 of the combustion chamber 20, the chamber wall 22 has moved downwards together with the combustion chamber valve 21 to release air tightness of the combustion chamber 20. In the case where the combustion chamber valve 21 is open at the downward stroke end position of the chamber wall 22, the chamber wall 22 may abut a stopper (not shown) provided in the cylinder 13, whereby the downward stroke end position of the chamber wall 22 can be restricted. In contrast, in the case where the combustion chamber valve 21 is closed at the upward stroke end position of the chamber wall 22, the chamber wall 22 may abut the cylinder head 16, whereby the upward stroke end position of the chamber wall 22 can be restricted. Here, in the case where the combustion chamber valve 21 may move upwards together with the chamber wall 22 via the upward movement of the chamber wall 22. If it reaches a closed position where it abuts the cylinder head 16, the combustion chamber 20 may be brought to a hermetically closed state.

An agitating fan 24 rotated by an electric motor 23 and an ignition plug (not shown) may be arranged inside the combustion chamber 20. The electric motor 23 and the ignition plug may be mounted to the cylinder head 16. The cylinder bead may be mounted to the upper portion of the main body case 12. The combustion chamber valve 21 (moved upwards together with the chamber wall 22), the piston 14 and the cylinder head 16 may form the hermetically closed combustion chamber 20. Here, the upward movement of the chamber wall 22 may be caused through the upward movement to the ON position of the driver guide 30. The leading end (lower end) of this driver guide 30 may be formed as a contact top 31 that can be pressed against the workpiece W. Thus, the relative movement (upward movement) of the driver guide 30 with respect to the tool main body 30 may be caused by bringing the contact top 31 into press contact with the workpiece W. In this way, the combustion chamber 20 may be closed upon bringing of the contact top 31 into press contact with the workpiece W. Further, a cassette-type gas cylinder 25 may be located within a lateral side portion of the tool main body 1. When the combustion chamber valve 21 moves to the closing position through the upward movement to the ON position of the driver guide 30, the gas cylinder 25 may supply flammable gas into the combustion chamber 20. Then, the electric motor 23 is started to rotate the agitating fan 24, generating an air-fuel mixture within the hermetically closed combustion chamber 20.

A handle portion 26 that can be grasped by the user with one hand may be provided on the lateral side portion of the tool main body 11. At the base portion of the handle portion 26, there is provided a switch lever 27 protruding toward the lower surface side and an ignition switch 28 configured to operate in conjunction with the operation of the switch lever 27. Thus, when the switch lever 27 is pulled with a finger of the hand grasping the handle portion 26, the ignition switch 28 may be turned on to ignite an ignition plug, thereby burning the air-fuel mixture. Then, the piston 14 may be impulsively caused to move downwards by the combustion pressure of the air-fuel mixture, generating a three for driving the driver 15. In the figures, reference numeral 29 indicates a rechargeable battery pack, which may be attached to the tool main body 11 as a power source for supplying power to this tool main body 11.

The driver guide 30 may be arranged at the lower portion the tool main body 11 constructed as described above, and the magazine 60 may be arranged one the lateral side of the driver guide 30. The driver guide 30 may be used for guiding the driver 15, etc., and for detecting the pressing state of the contact top 31 at the leading end against the workpiece W.

As shown in FIG. 1, nail bundles 81 may each consist of ten nails bundled together. Such nail bundles 81 may be loaded into the driver guide 30. Each of the nail bundles 81 may be formed by bundling up ten nails 80 in parallel by a bundle resin strip 87 that may be molded by a suitable resin. That is, in each bundle resin strip 87, ten nails 80 may be bundled into a unit, and the bundle may be broken by the impact when each of the nails is driven as a driven nail 85 by the driver 15. Instead of being broken, the bundle may be compressed by the impact when each of the nails is driven as the driven nail 85 by the driver 15. In this way, the nails of each nail bundle 81 may be successively driven one by one a the driven nail 85 by the driver 15, leaving the last one nail 80 not bundled. This remaining last one nail of the ten nails is called as the last nail 83. While not bundled with the other nails 80, the bundle resin strip 87 may be left around the last nail 83. That is, the bundle resin strip 87 formed through resin molding may be left around each of the nails 80 of the nail bundle 81 until each nail has been driven by the driver 15.

The nail bundles 81 thus bundled up are pitch-fed into the driver guide 30 one by one from the magazine 60 in conjunction with the driving operation of the tool main body 11. In this way, the nails 80 supplied into the driver guide 30 may be driven by the driver 15 as the driven nails 85. For this purpose, the magazine 60 may be provided with a feeding mechanism 65 configured to pitch-feed the nail bundles 81 one by one into the driver guide 30 in conjunction with the driving operation of the tool main body 11.

Figure 2:
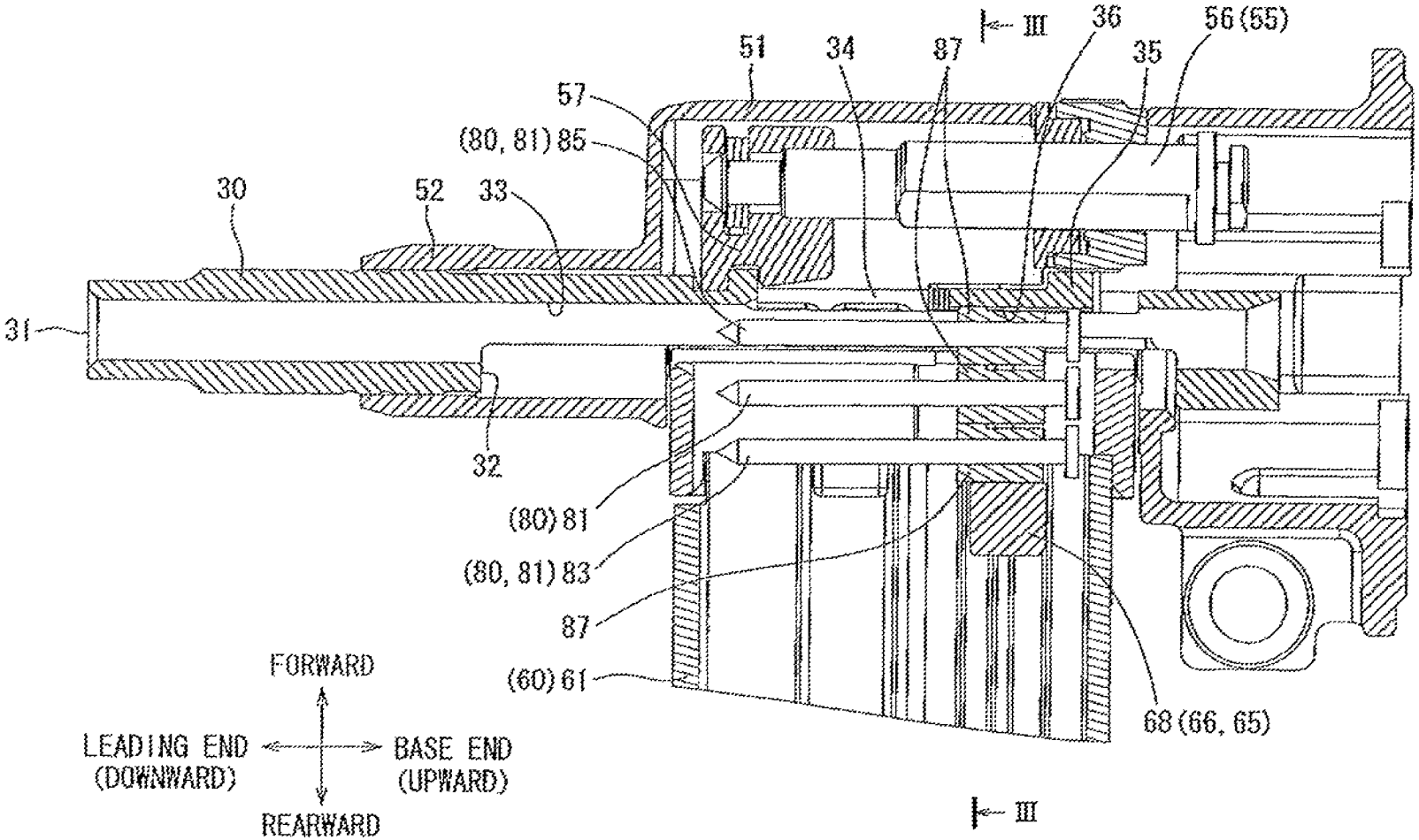
FIG. 2 is a structural sectional view illustrating the internal structure of a driver guide in an initial state in which driving is not possible.
Figure 3:
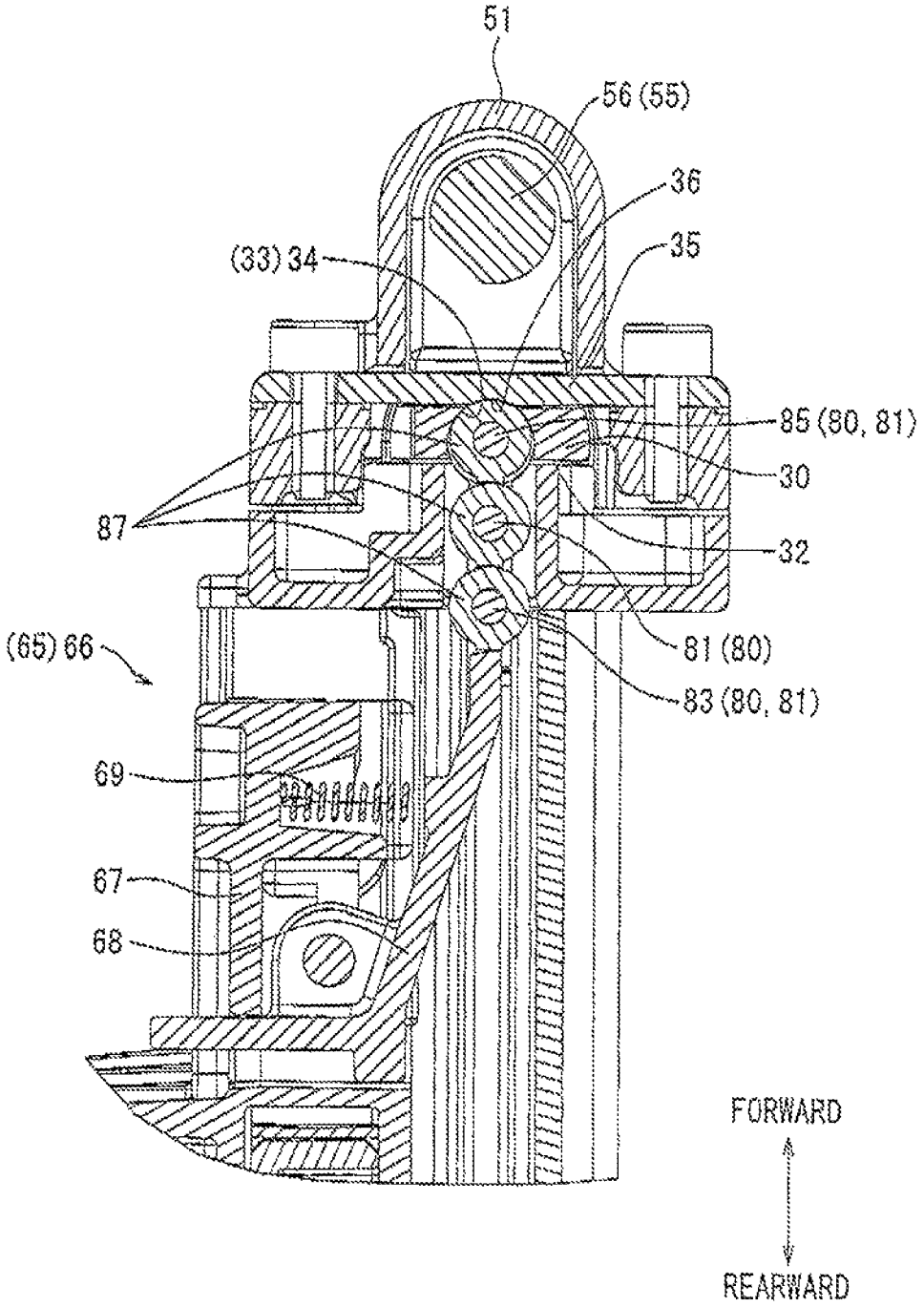
FIG. 3 is a structural sectional view taken along the arrow line III-III of FIG. 2.
Figure 4:
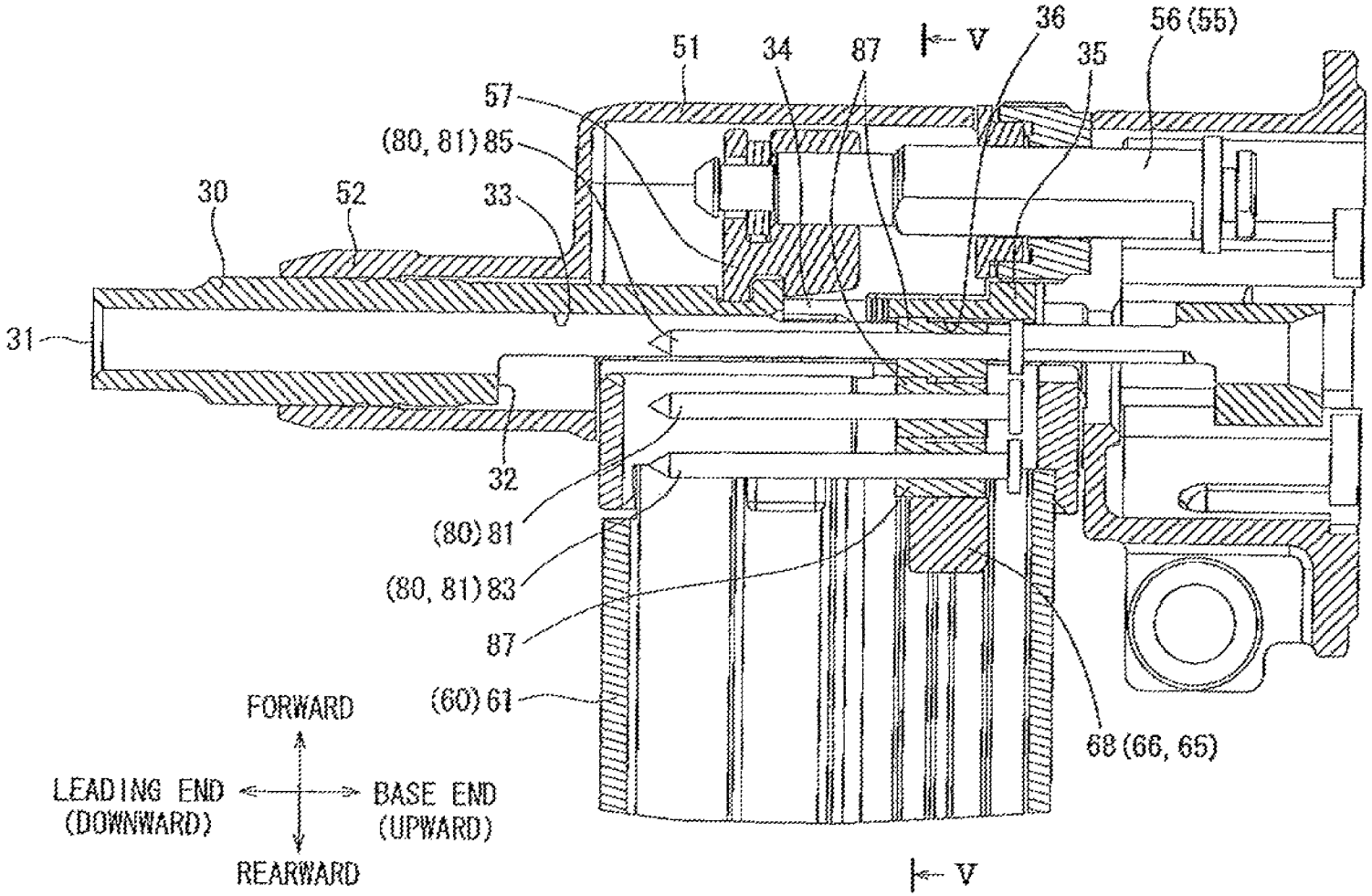
FIG. 4 is a structural sectional view illustrating the internal structure of the driver guide during a midway point of a contact movement wherein driving (of a nail) is not possible.
Figure 5:
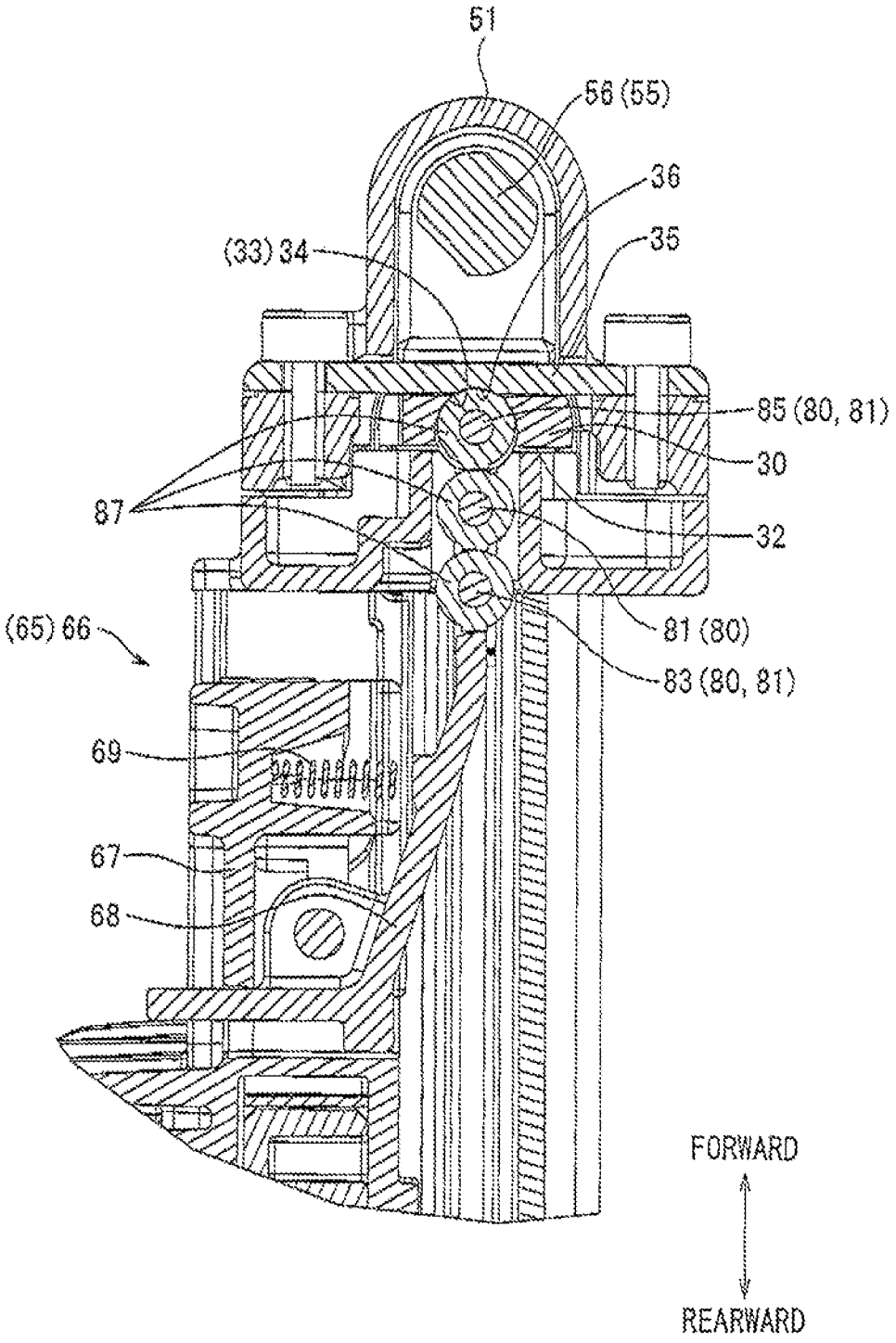
FIG. 5 is a structural sectional view taken along the arrow line V-V of FIG. 4.
Figure 6:
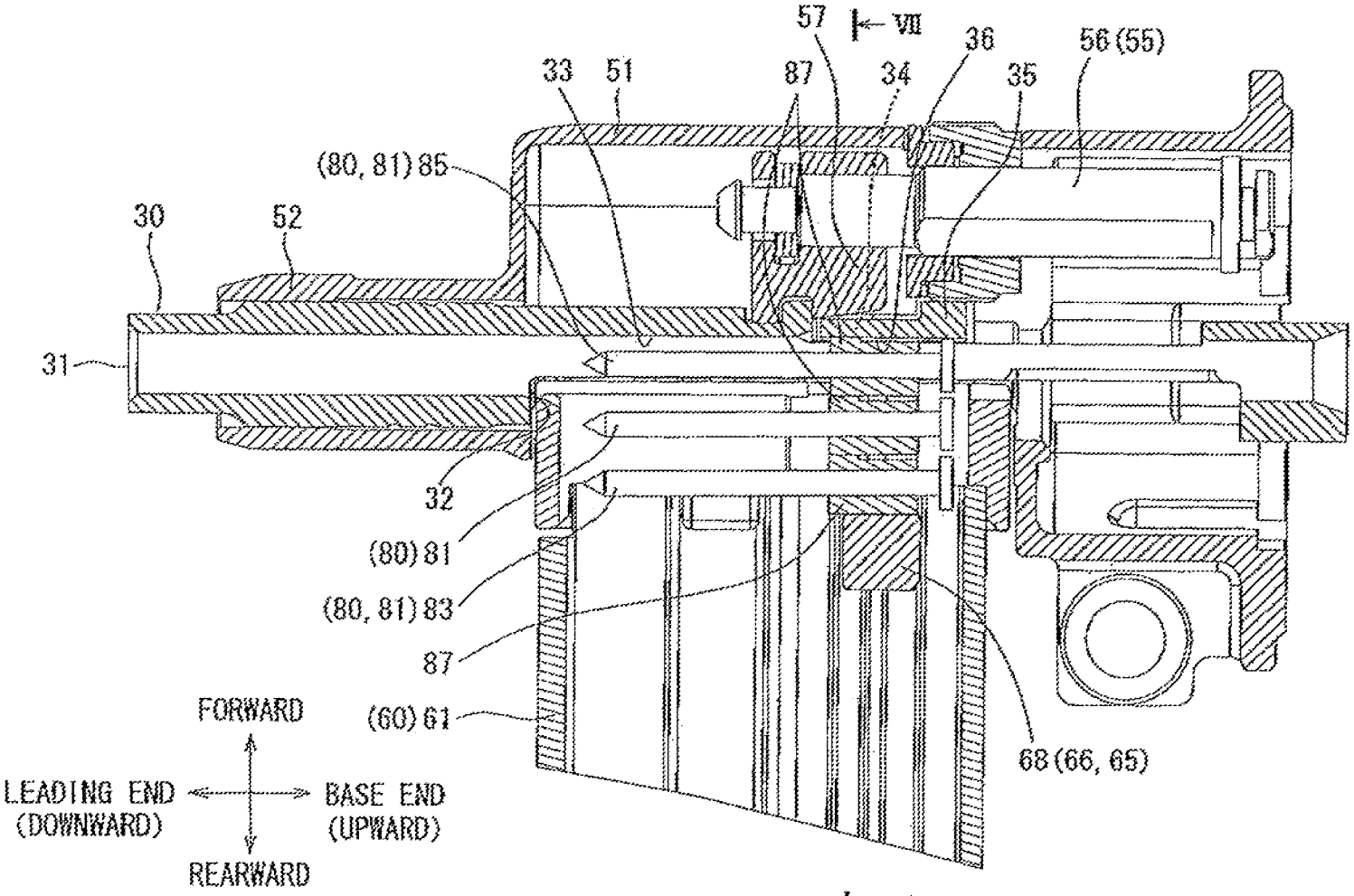
FIG. 6 is a structural sectional view illustrating the internal structure of the driver guide in a completed contact movement wherein driving is possible.
Figure 7:
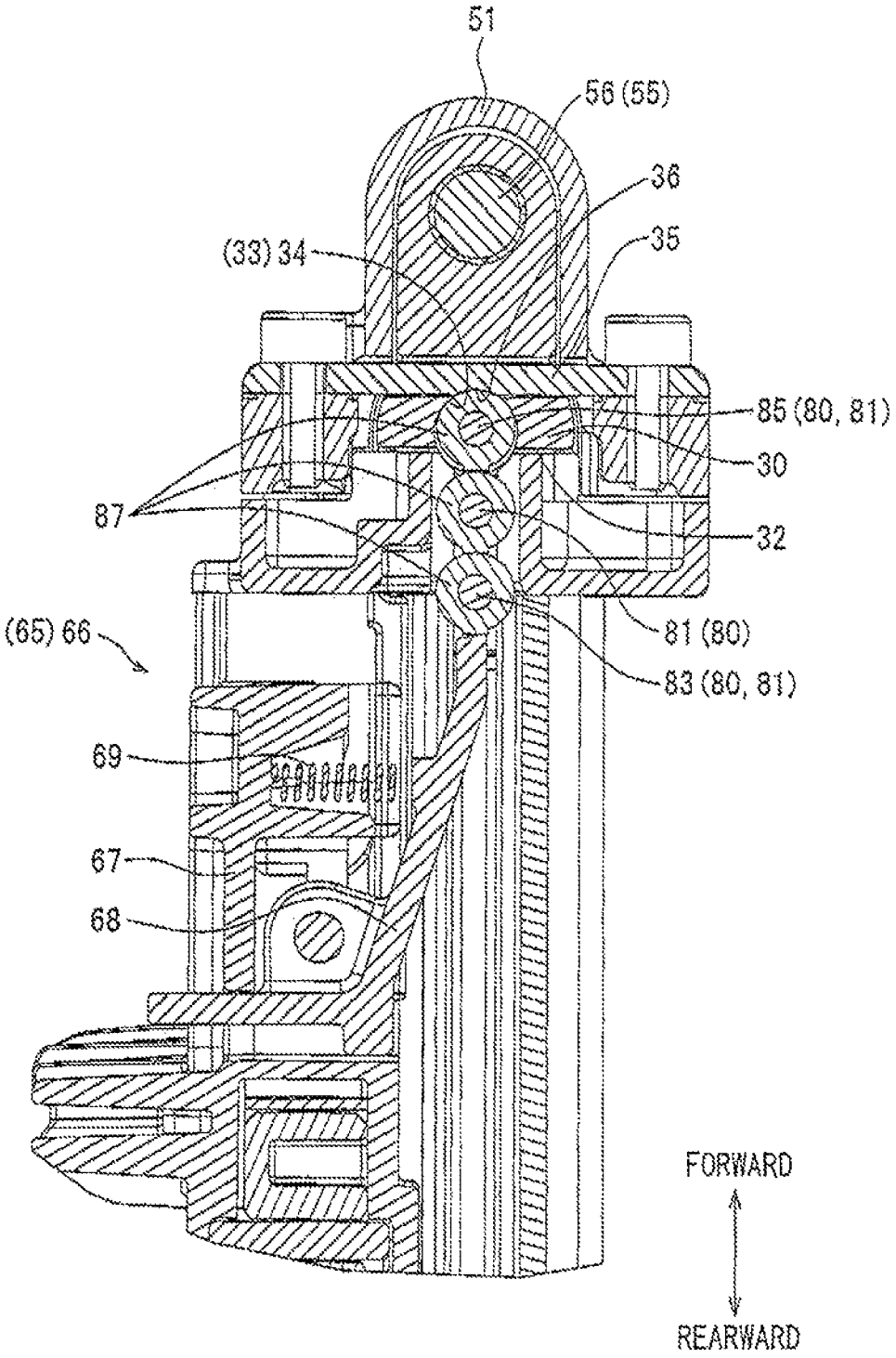
FIG. 7 is a structural sectional view taken along the arrow line VII-VII of FIG. 6.

Next, the driver guide 30 will be described along with the peripheral structure thereof. FIG. 2 is a structural sectional view illustrating the internal structure of the driver guide 30 in the initial state where the driving operation is inhibited. FIG. 3 is a structural sectional view taken along the arrow line III-III of FIG. 2. FIG. 4 is a structural sectional view illustrating the internal structure of the driver guide 30 at a midway point in the movement of the contact top 31, where the driving operation is inhibited. FIG. 5 is a structural sectional view taken along the arrow line V-V of FIG. 4. FIG. 6 is a structural sectional view illustrating the internal structure of the driver guide 30 in a state where the movement of the contact top 31 has been completed to allow the driving operation. FIG. 7 is a structural sectional view taken along the arrow line VII-VII of FIG. 6. In order to enable easy understanding of the driver guide 30, the nail 80 is shown to be ejected to the left side in FIGS. 2, 4, and 6.

As shown in FIGS. 2 and 3, the feeding mechanism 65 may be equipped with a pusher assembly 66, and a feed-urging spring (not shown) urging the pusher assembly 66. The feed-urging spring may urge the pusher assembly 66 to slidably move toward the driver guide 30. That is, as shown in FIGS. 2 and 3, as the pusher assembly 66 slidably moves toward the driver guide 30, a pusher member 68 of the pusher assembly 66 may push the nail bundles 81 loaded in the magazine 60 so as to supply them into the driver guide 30.

The pusher assembly 66 may generally include a holder 67, a pusher member 68, and an urging spring 69. The holder 67 may be supported so as to be capable of slidably moving with respect to the magazine main body 61 while receiving the urging force of the feed-urging spring (not shown). The pusher member 68 may push the nail bundles 81 while being pivotally supported by the holder 67. The urging spring member 69 may urge the pusher member 68 into a pushing position whereby it can push the nail bundles 81. When the pusher member 68 is retracted, new nail bundles 81 can be loaded into this magazine 60.

Due to the impact applied by the tool main body 11, the driver 15 may drive the driven nails 85 from the nil bundles 81 supplied by the magazine 60 into the workpiece W. Thus, the driver guide 30, which is arranged so as to allow insertion of the driver 15, is endowed with the function of guiding the driving movement of the driver 15, and the function of guiding the ejecting movement of the driven nail 85 from the driver 15 along an ejection path.

As shown in FIG. 1, a nose case 51 may be attached to the lower portion of the tool main body 11. The lower portion (leading end portion) of this nose case 51 may be formed as a tubular guide portion 52. The lower portion of the driver guide 30 may be inserted into the guide portion 52. The base end side of the driver guide 30 may be guided and supported so as to be capable of moving vertically by a guide support structure inside the nose case 51, and the leading end side of the driver guide 30 may be guided and supported so as to be vertically movable by a guide support structure of the guide portion 52 of the nose case 51.

In addition to its inherent function as a driver guide, the driver guide 30 also functions as a contact arm for detecting the press-contact state with respect to the workpiece W (object of driving). Such detection may be made through a contact mechanism 55 arranged adjacently to the driver guide 30 inside the nose case 51. That is, as described above, the leading end (lower end) of the driver guide 30 is formed as the contact top 31 that may be pressed to contact with the workpiece W, and the driver guide 30 is capable of making relative movement with respect to the tool main body 11. That is, the driver guide 30 is endowed with the unction of guiding the driver 15, and the function of closing the combustion chamber 20 by upwardly moving the chamber wall 22 through press contact of the contact top 31 with respect to the workpiece W (object of driving). In the normal state, in which the contact top 31 is not in contact with the workpiece W (object of driving), the chamber wall 22 may be positioned downwards to open the combustion chamber 20.

The contact mechanism 55 may be configured to move the chamber wall 22 in conjunction with the movement of the driver guide 30 that also functions as the contact arm. More specifically, the contact mechanism 55 may include a conjunction movement rod 56 configured to move the chamber wall 22 in conjunction therewith. This conjunction movement rod 56 is engaged with the driver guide 30 at an engagement portion 57. The conjunction movement rod 56 configured to move in conjunction with the driver guide 30 may be coupled to the chamber wall 22 via a connection member (not shown). In this way the driver guide 30 with the contact top 31 pressed against the workpiece W may move relative to the tool main body 11 (upward movement), whereby the chamber wall 22 may be moved upwards via the contact mechanism 55 to thereby hermetically seal the combustion chamber 20.

Inside the driver guide 30, there may be provided a holding mechanism for holding the driven nail 85 at a driving position inside the driver guide 30. As shown in FIGS. 2 and 3, the driving position of this driven nail 85 corresponds to the position of the driven nail 85 fed into the driver guide 30 from the magazine 60 by the feeing mechanism 65. The driven nail 85 of the nail bundle 81 is supported by the other nails of the nail bundle 81 loaded into the magazine 60. Further, as shown in FIGS. 2 and 3, on the side of where the magazine 60 is arranged, the driver guide 30 may be formed with an opening 32 for receiving the nail bundle 81 loaded in the magazine so that the driven nails 86 can be supplied into the driver guide 30. The range of the opening 32 may be set in correspondence with the movement range in which the driver guide 30 makes relative movement with respect to the tool main body 11. Thus, even when the driver guide 30 is situated at the lowermost end (lower stroke end), or even when the driver guide 30 is situated at the uppermost and (upper stroke end), it is possible to supply the driven nail 85 into the driver guide 30.

An opening 34 may be formed in an inner peripheral wall 33 of the driver guide 30 so as to be positioned opposite the opening 32. Like the above-mentioned opening 32, the range of the opening 34 may be set in correspondence with the movement range in which the driver guide 30 makes relative movement with respect to the tool main body 11. More specifically, the opening 34 may be formed to have a rectangular configuration in conformity with the movement distance of the driver guide 30. In this way, even when the driver guide 30 is situated at the lowermost end (lower stroke end), or even when the driver guide 30 is situated at the uppermost and (upper stroke end), the opening 34 may allow a pressing surface 36 of an internally exposed member 35 to be exposed inside the driver guide 30.

The internally exposed member 35 may be formed as a substantially flat plate, and may be fixedly supported by the nose case 51, which is integrated with the tool main body 11. That is, like the nose case 51, the internally exposed member 35 may also be integrated with the tool main body 11. The internally exposed member 35 may be a separate member from the driver guide 30. In this way, the internally exposed member 35 may not move in conjunction with the relative movement of the driver guide 30 with respect to the tool main body 11 but may be fixed to the tool main body 11 so as to be integral with the tool main body 11. The surface of the internally exposed member 35 exposed inside the driver guide 30 may be formed as the pressing surface 36 against which the driven nail 85 fed toward the driving position inside the driver guide 30 may be pressed. The driven nail 85 may be pressed against the pressing surface 36 by the feeding force of the feeding mechanism 65 provided in the magazine 60.

The driven nail 85 thus pressed against the pressing surface 85 may be held at the driving position inside the driver guide 30 independently of the relative movement of the driver guide 30 with respect to the tool main body 11 until it is driven by the driver 15. That is, as described above, even when the driver guide 30 makes relative movement with respect to the tool main body 11, the driven nail 85 may not receive a frictional force from the driver guide 30 but can be held at the driving position inside the driver guide 30 until it is driven by the driver 15. In other words, even when the driver guide 30 moves toward the base end side through the press contact of the contact top 31 with the workpiece W, the driven nail 85 pressed against the pressing surface 36 by the feeding force of the feeding mechanism 65 may not be displaced from the driving position, i.e., it is not moved.

The internally exposed member 35 may be comprised of a pressing surface 36 and an opening 34 in the driver guide 30. This may allow the pressing surface 36 to be exposed inside the driver guide 30 and serve as a driven member holding mechanism that holds the driven nail 85 at the driving position inside the driver guide 30 until the driven nail 85 is driven by the driver 15. The pressing force with which the driven nail 85 is pressed against the pressing surface 36 of the internally exposed member 35 may be provided by the feeding mechanism 65 of the magazine 60.

Here, the driven nail 85 may be pressed against the pressing surface 36 of the internally exposed member 35 exposed inside the driver guide 30 via the bundle resin strip 87 covering the outer peripheral surface of the driven nail 85. Therefore, the bundle resin strip 87 covering the driven nail 85 may be pressed against the pressing surface 36 of the internally exposed member 36 irrespective of whether the driven nail is the last nail 83 of the nail bundle 81 or one of the other nails of the nail bundle 81.

According to the combustion-type driving tool 10 described above, the driver guide 30 is formed as a movable driver guide movable relative to the tool main body 11, so that when the ejection end of the driver guide 30 is brought into press contact with the workpiece W for driving the nails 80, the driver guide 30 moves relative to the tool main body 11, making it possible to detect the press-contact state.

In addition, it is possible to press the driven nail 85 against the pressing surface 36 of the internally exposed member 35, which is exposed inside the driver guide 30, by the feeding mechanism 65 feeding the nails toward the driving position. Here, the internally exposed member 35 having the pressing surface 36 is formed as a separate member from the driver guide 30, so that, in this combustion-type driving tool 10, even when the driver guide 30 moves from the leading end side toward the base end side, i.e., the side of the tool main body 11, it is possible to press the last nail 83 against the pressing surface 36. This makes it possible to support the last nail 83 in position at the correct driving position inside the driver guide 30.

Further, the driver guide 30 may be provided with an opening 34 for exposing the pressing surface 36 of the internally exposed member 35. The internally exposed member is located inside the driver guide 30. Therefore, it is possible to expose the pressing surface 36 of the internally exposed member 35 inside the driver guide 30 by simply forming the opening 34, enabling simplification in its production.

Furthermore, the resin-molded bundle resin strip 87 bundling together a plurality of nails 80 may cover the outer peripheral surface of the driven nail 85. The pressing of the driven nail 85 against the pressing surface 36 may be applied via the bundle resin strip 87 covering the driven nail 85. In this way, it is easier to produce a frictional force when pressing the drive nail 85. This can be advantageous in supporting the last nail 83 at a determined position.

Furthermore, the leading end of the driver guide 30 may be formed as the contact top 31 that is brought into press contact with the workpiece W. Therefore, it is possible to provide the driver guide 30 with the function of detecting whether or not the driver guide 30 is being held in press contact, and achieve a reduction in the number of components. Further, as the contact top 31 is pressed against the workpiece W, the combustion chamber 20 of the tool main body 11 is closed, so that it is possible to reduction the number of components.

Next, a driving tool according to a second embodiment will be described with reference to the drawings. The second embodiment differs from the first embodiment in the structure of the driver guide 30 of the combustion-type driving tool 10. Thus, in the following, the description will be focused primarily to the structure of a driver guide 30A of the second embodiment. The portions and components formed in the same way as those of the combustion type-driving tool 10 according to the first embodiment will be labeled with the same reference numerals, and a description thereof will be omitted or made in brief.

Also in this second embodiment, the nails 80 bundled into the nail bundle 81 may be used as in the first embodiment. That is, the resin-molded bundle resin strip 87 may be provided on the outer peripheral surface of the nails 80.

In the first embodiment described above, the driven member holding mechanism is configured to include the internally exposed member 35. The driven member holding mechanism may be equipped with a pressing surface 36, and the opening 34 of the driver guide allowing the pressing surface 36 to be exposed inside the driver guide 30. In contrast, a driven member holding device according to the second embodiment may include a holding mechanism 70 for holding the driven nail 85 at the driving position inside the driver guide 30. That is, the driven member holding mechanism according to the first embodiment described above holds the driven nail 85 at the driving position inside the driver guide 30 by pressing it from the lateral side through utilization of the feeding force applied to the nail bundle 81 by the feeding mechanism 65. In contrast, according to the driven member holding mechanism of the second embodiment, a claw 75 may protrude into a driving path 300 in front of the driven nail 85 existing at the driving position, whereby the claw 75 engages the bundle resin strip 87 of the driven nail 85, thus making it possible to hold the driven nail 85 through this engagement.

Figure 8:
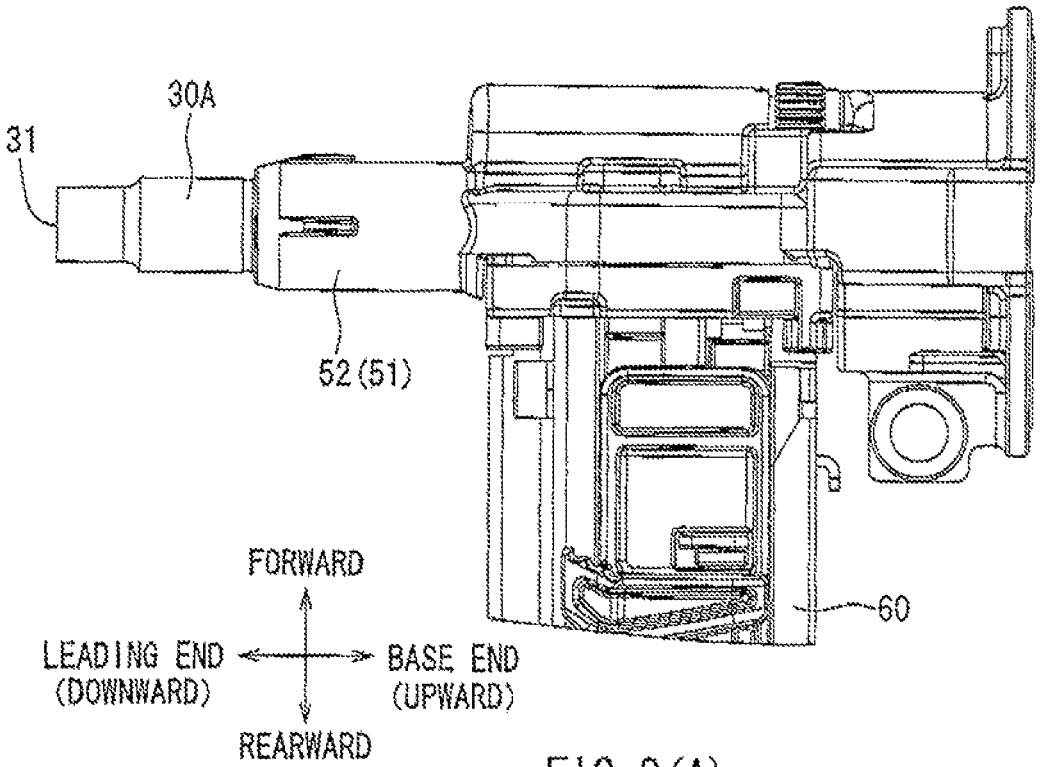
Figure 8:
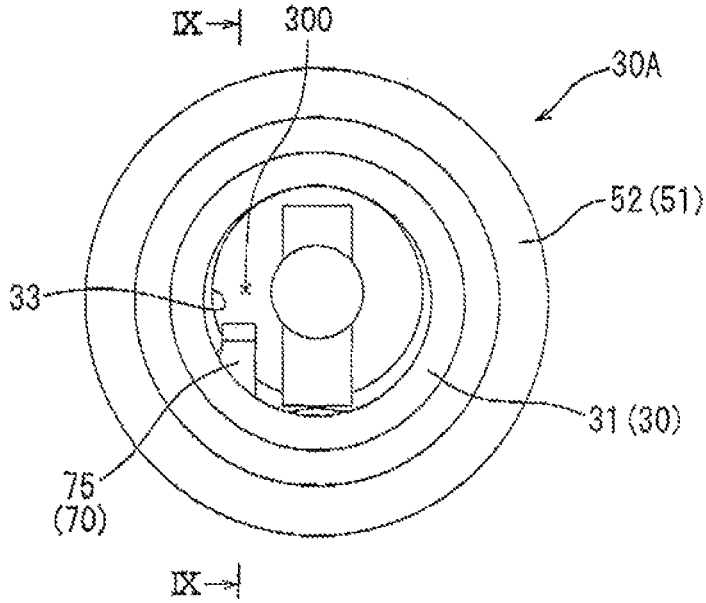
Figure 9:
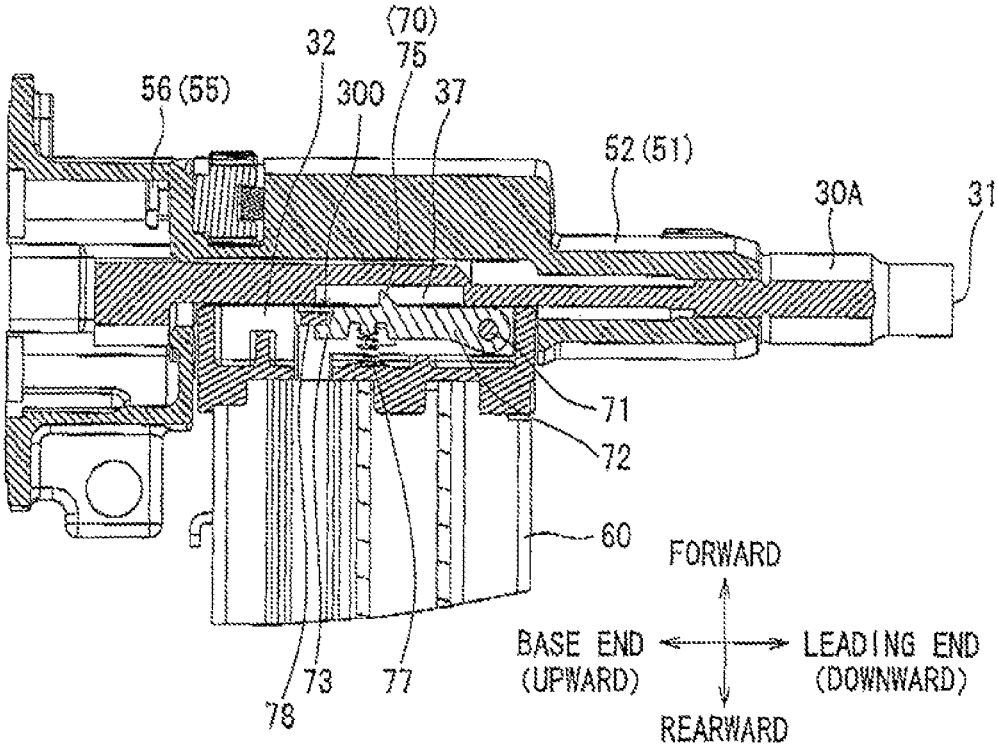
FIGS. 9A and 9B are structural sectional views taken along the arrow line IX-IX of FIG. 8.
Figure 9:
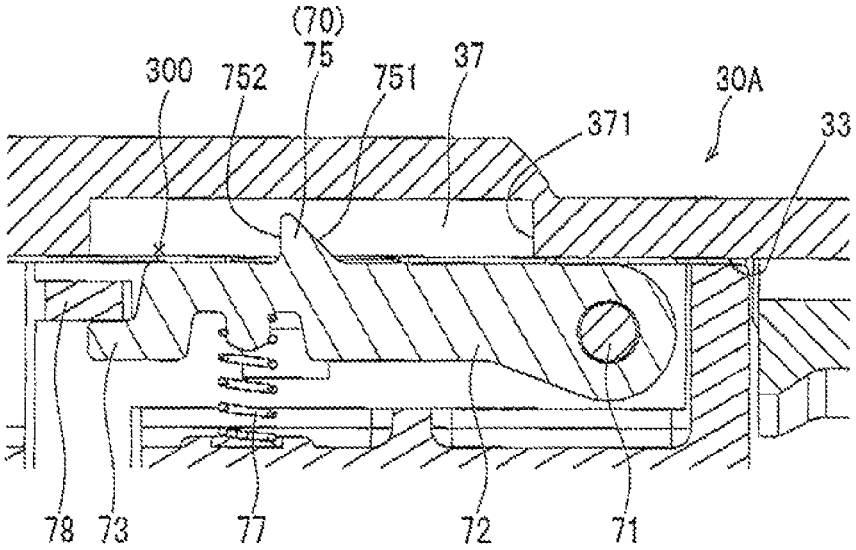
Figure 10:
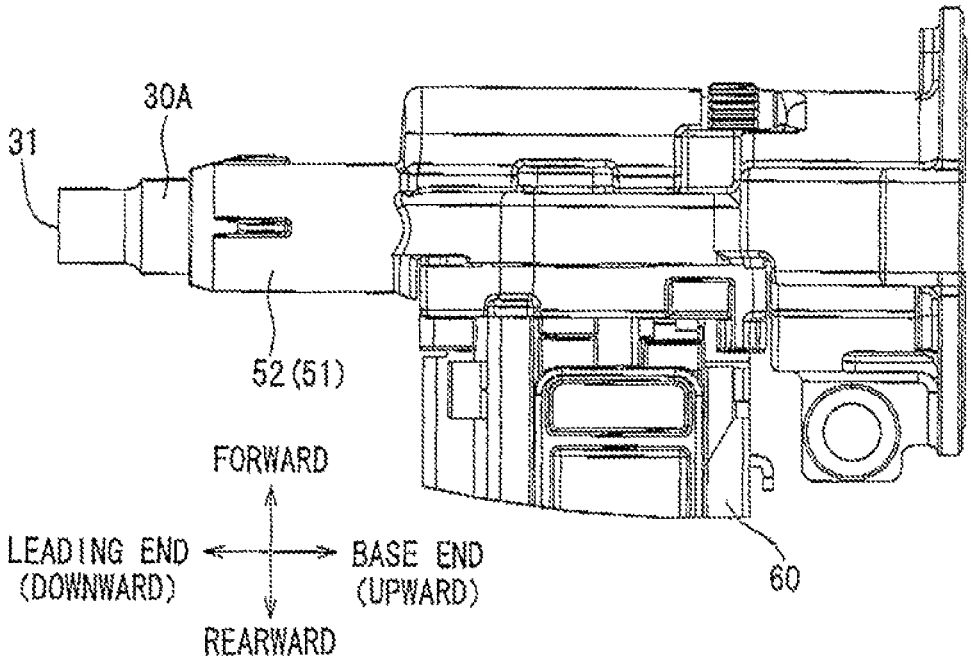
FIGS. 10A and 10B are a side view of the driver guide and a front view of the shooting port at a first stage, respectively.
Figure 10:
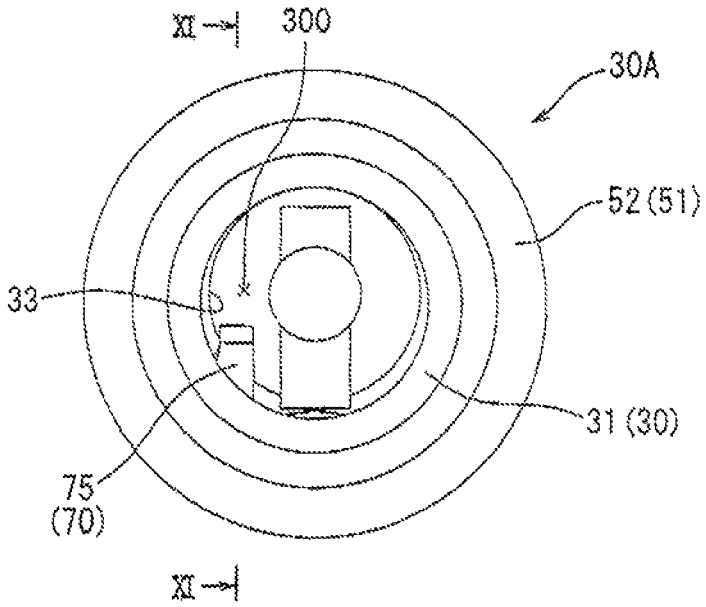
Figure 11:
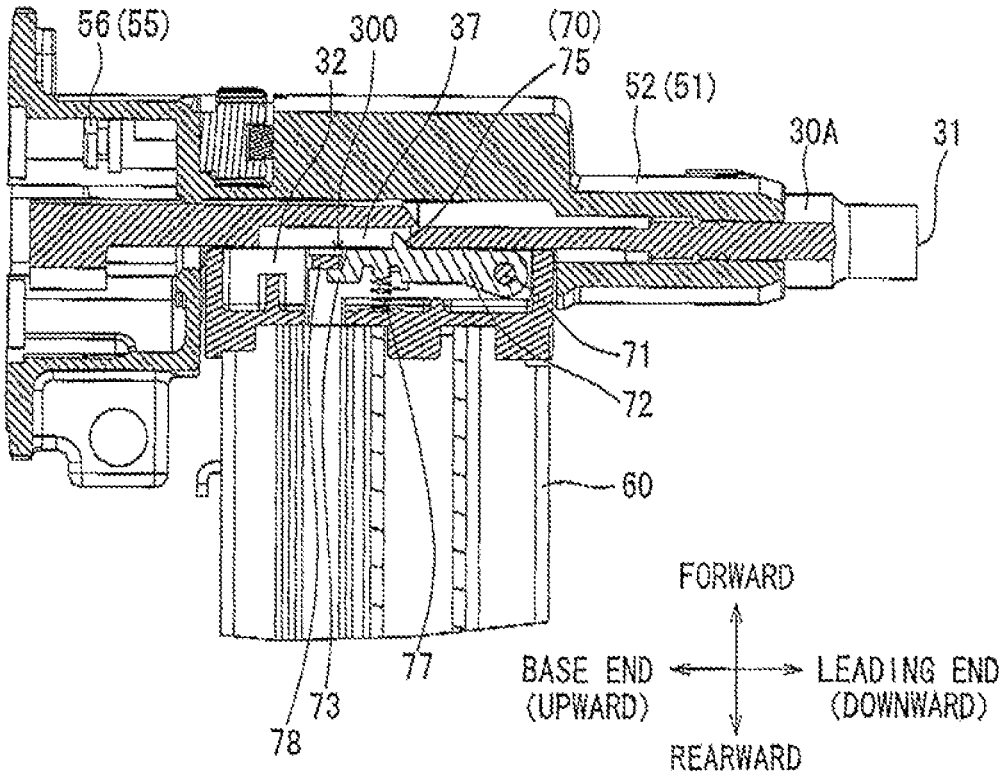
FIGS. 11A and 11B are structural sectional views taken along the arrow line XI-XI of FIG. 10.
Figure 11:
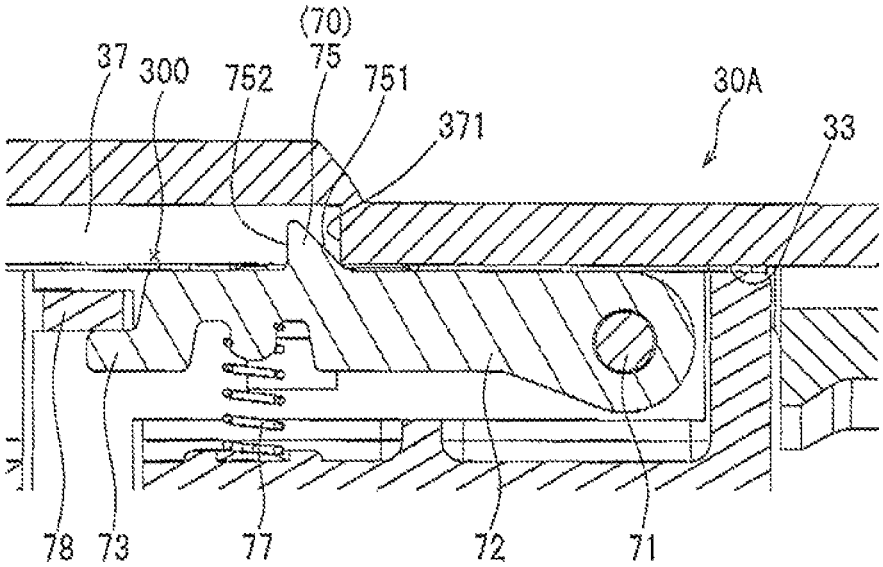
Figure 12:
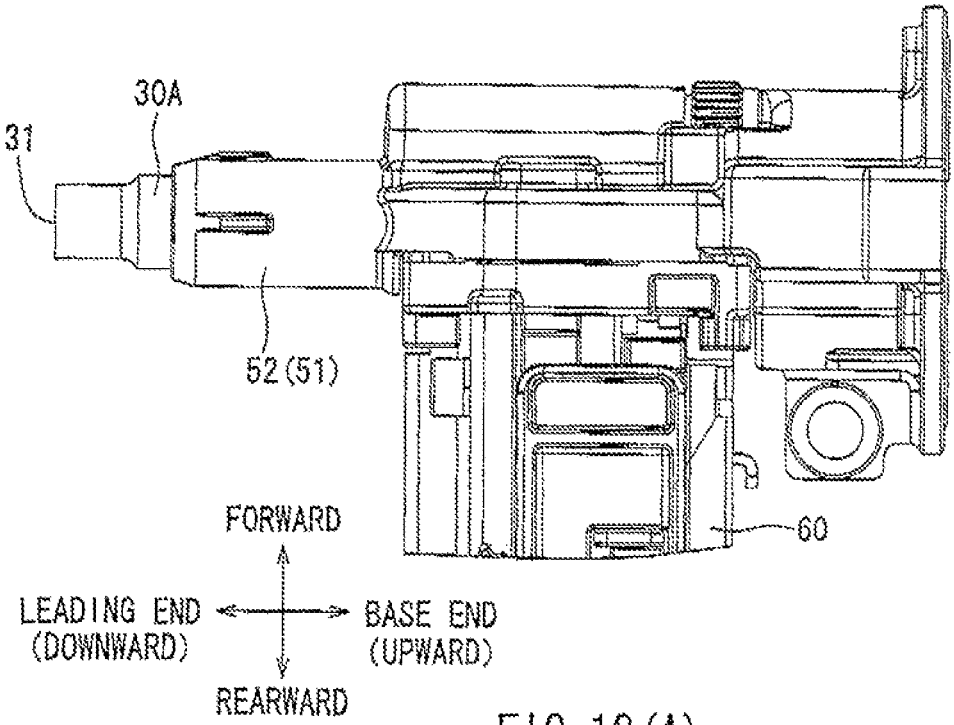
FIGS. 12A and 12B are a side view of the driver guide and a front view of the shooting port at a second stage, respectively.
Figure 12:
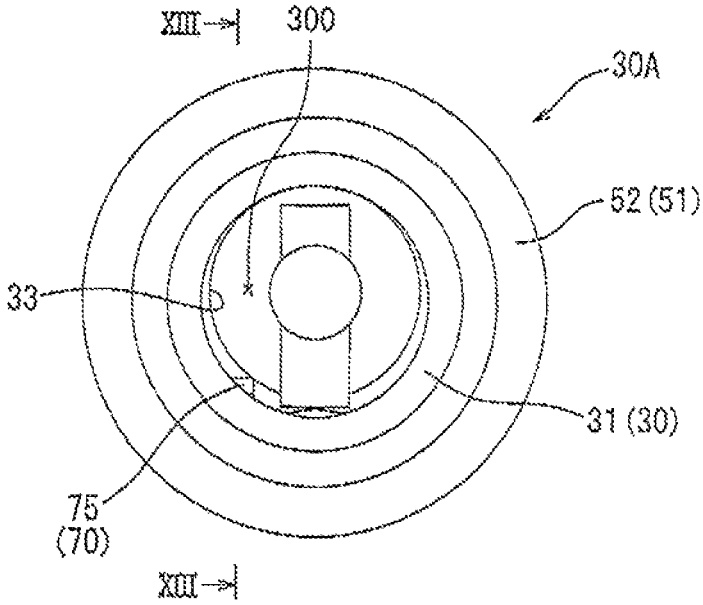
Figure 13:
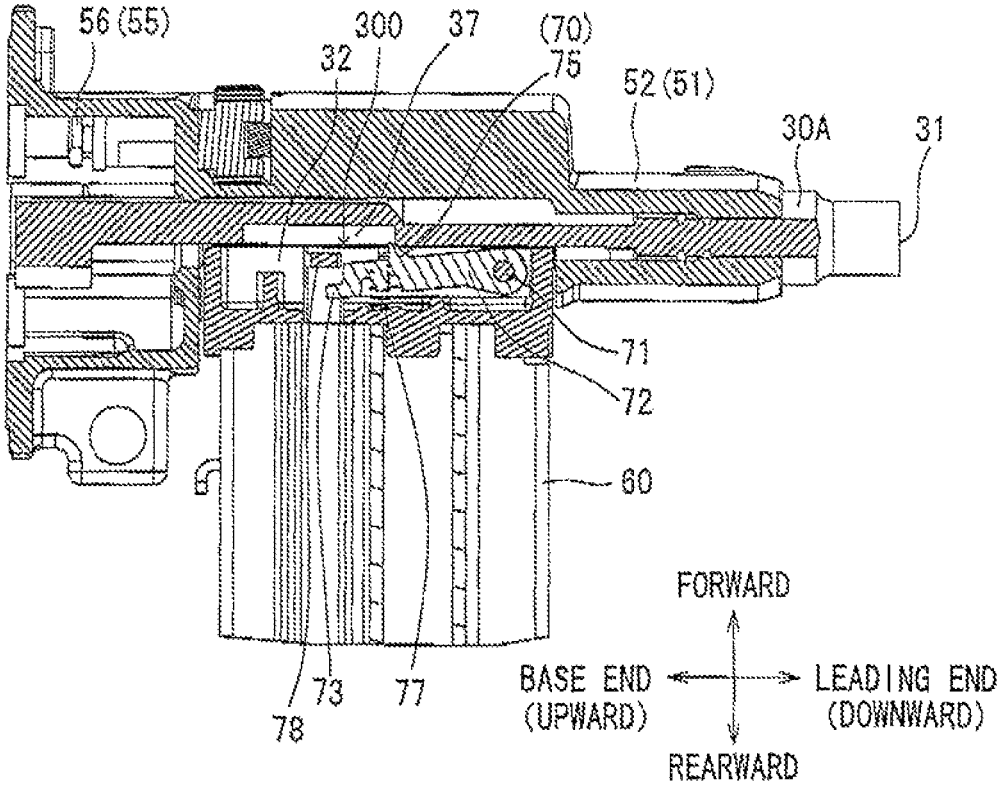
FIGS. 13A and 13B are structural sectional views taken along the arrow line XIII-XIII of FIG. 12.
Figure 13:
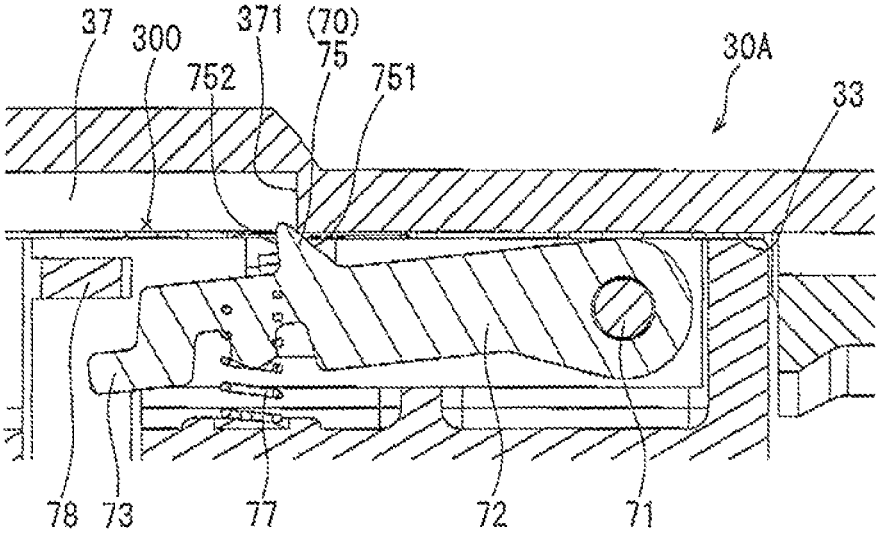
Figure 14:
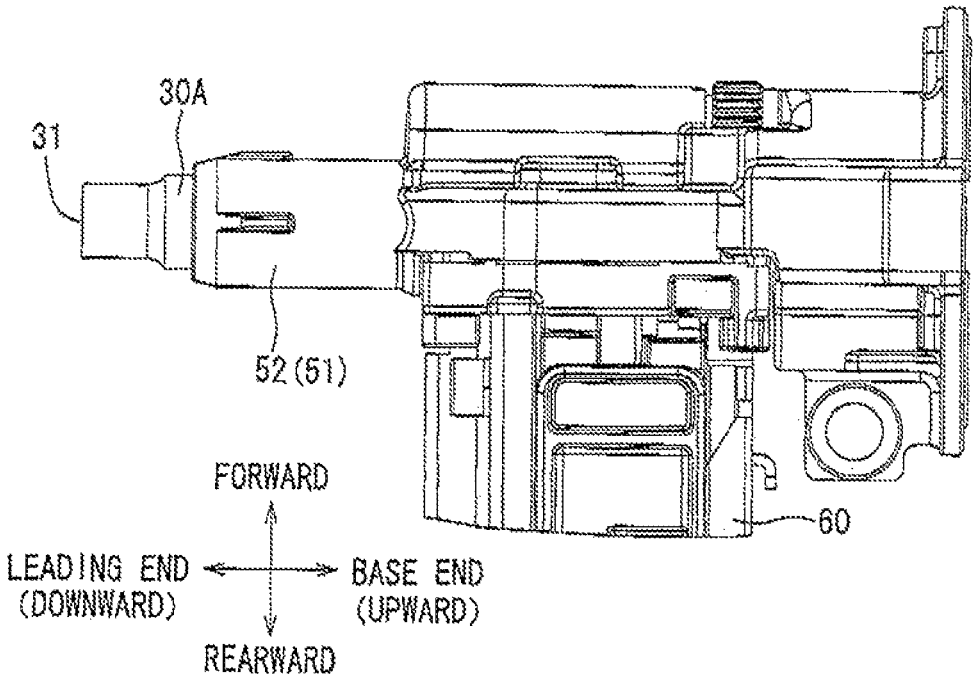
FIGS. 14A and 14B are structural sectional views of the internal structure of the driver guide at a third stage.
Figure 14:
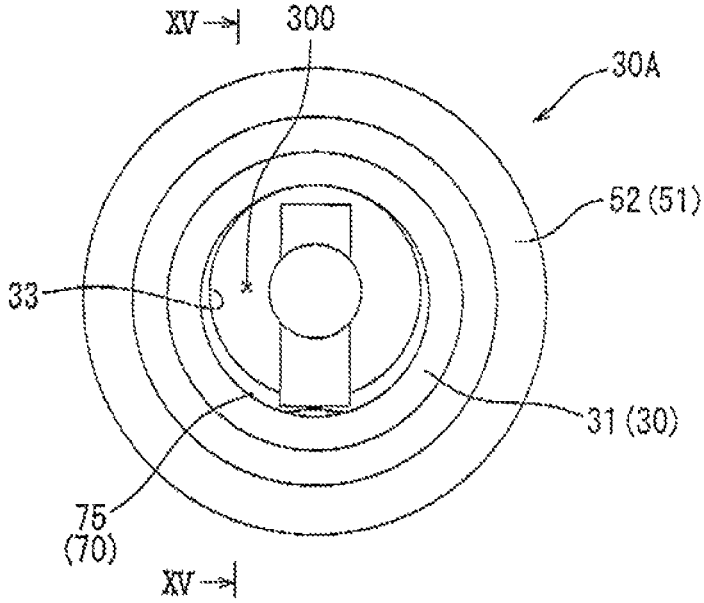
Figure 15:
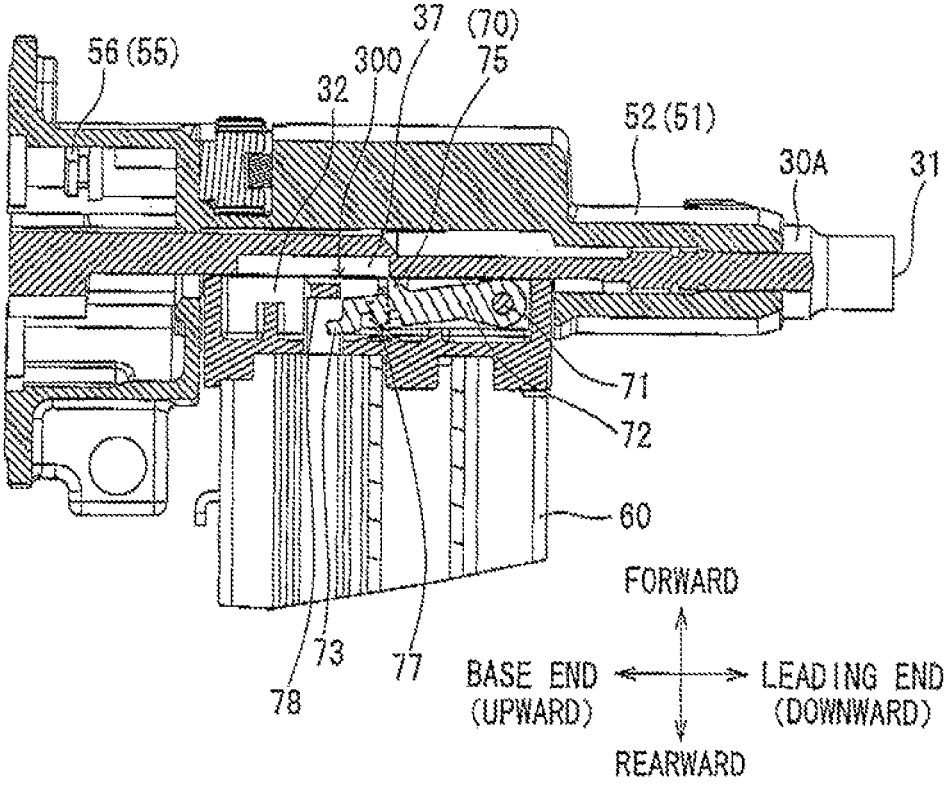
FIGS. 15A and 15B are structural sectional views taken along the arrow line XV-XV of FIG. 14B.
Figure 15:
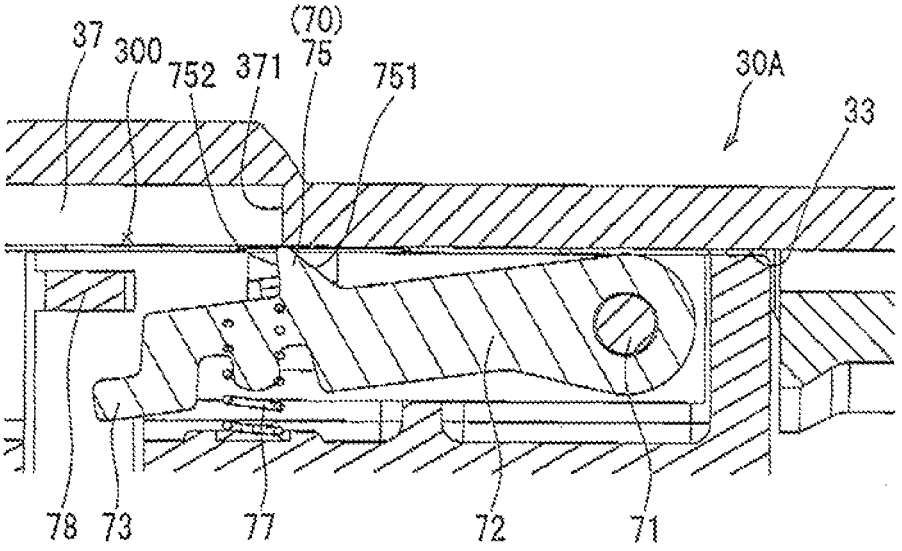
Figure 16:
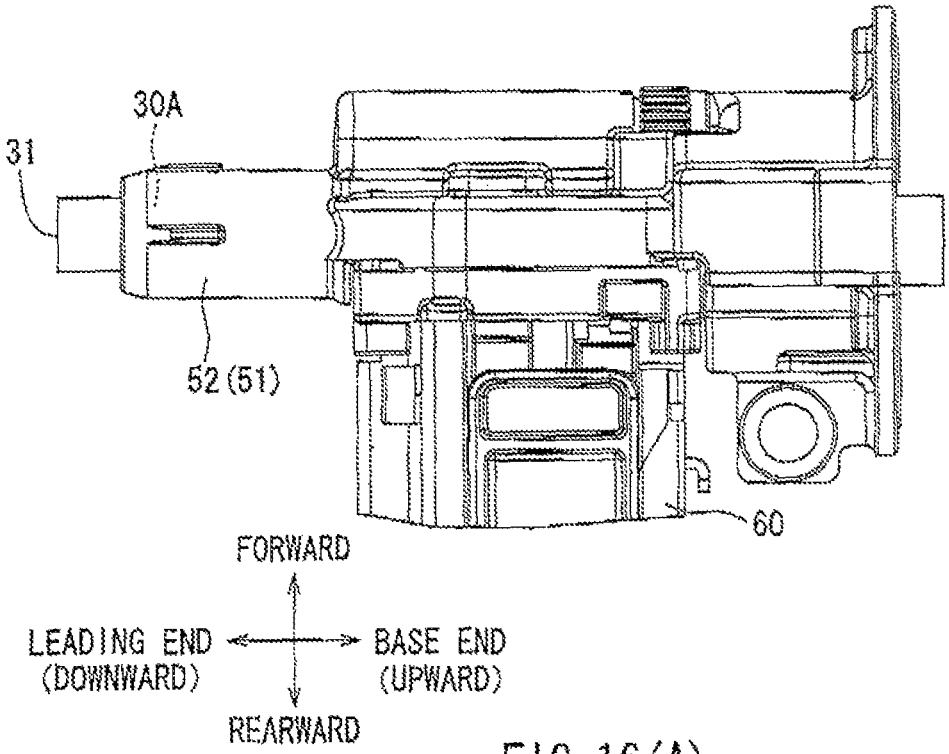
FIGS. 16A and 16B are a side view of the driver guide and a front view of the shooting port at a fourth stage, respectively.
Figure 16:
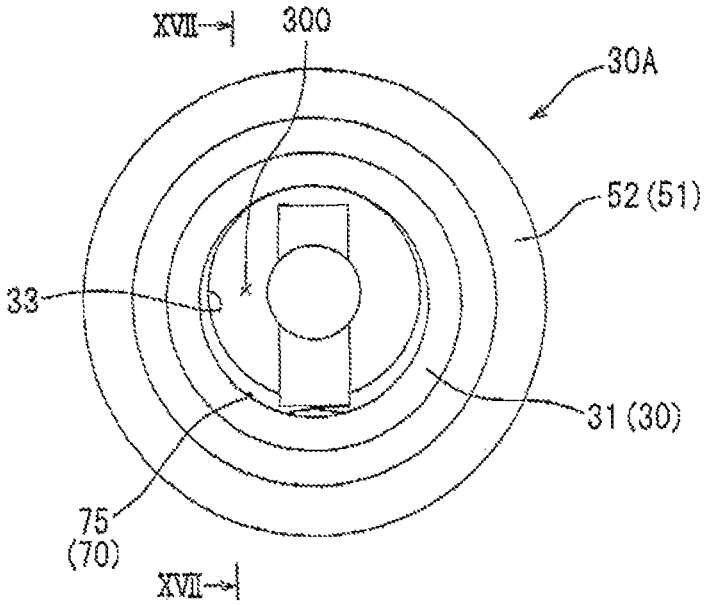
Figure 17:
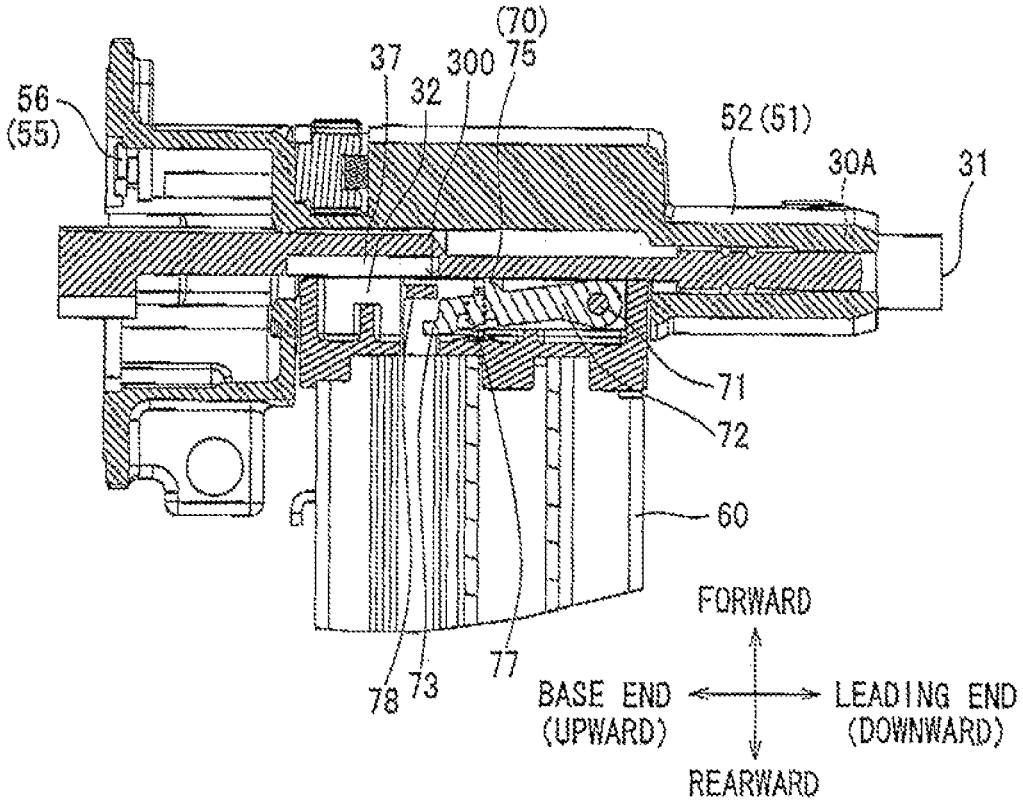
FIGS. 17A and 17B are structural sectional views taken along the arrow line XVII-XVII of FIG. 16B.
Figure 17:
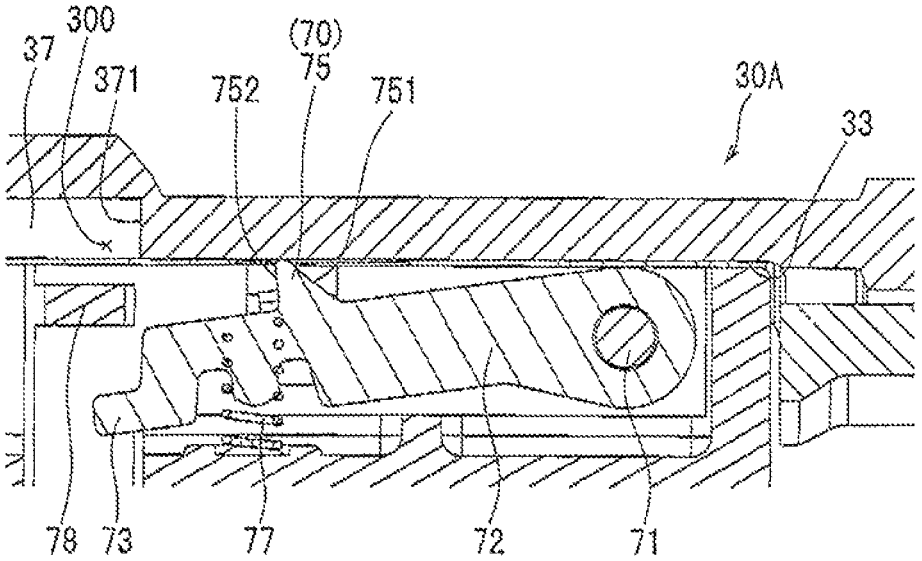

FIGS. 8A through 17B are views illustrating the driver guide 30A according to the second embodiment. FIG. 8A is a side view of the driver guide 30A in the initial stage. FIG. 8B is a front view of the ejection port of the driver guide 30A shown in FIG. 8A. FIG. 9A is a structural sectional view taken along the arrow line IX-IX of FIG. 8B. FIG. 9B is an enlarged sectional view of the holding mechanism 70. FIGS. 10A, 10B, 11A, and 11B illustrate a first stage of movement of the driver guide 30A; FIGS. 12A, 12B, 13A, and 13B illustrate a second stage of the movement of the driver guide 30A; FIGS. 14A, 14B, 15A, and 15B illustrate a third stage of movement of the driver guide 30A; and FIGS. 16A, 16B, 17A, and 17B illustrate a fourth stage of movement of the driver guide 30A. The illustrations in FIGS. 10A, 10B, 12A, 12B, 14A, 14B, 16A, and 16B correspond to the illustration of the driver guide 30A in FIGS. 8A and 8B; and the illustrations in FIGS. 11A, 11B, 13A, 13B, 15A, 15B, 17A, and 17B correspond to the illustration of the driver guide 30A in FIGS. 9A and 9B.

The driver guide 30A may move from the base end side toward the leading end side with respect to the tool main body 11 in the following order FIGS. 8A and 8B (FIGS. 9A and 9B); FIGS. 10A and 10B (FIGS. 11A and 11B), FIGS. 12A and 12B (FIGS. 13A and 13B), FIGS. 14A and 14B (FIGS.

15A and 15B), and FIGS. 16A and 16B (FIGS. 17A and 17B). FIGS. 8A and 8B (FIGS. 9A and 9B) are views illustrating the state in which the contact top 31 of the driver guide 30A has not been pressed against the workpiece W. FIGS. 10A and 10B (FIGS. 11A and 113) are views illustrating the state in which the contact top 31 of the driver guide 30A is slightly pressed against the workpiece W. In contrast, FIGS. 12A and 12B (FIGS. 11A and 13B) and FIGS. 14A and 14B (FIGS. 15A and 15B) are views illustrating the state in which the contact top 31 of the driver guide 30A is being pressed against the workpiece W to cause movement of the driver guide 30A. FIGS. 16A and 16B (FIGS. 17A and 17B) are views illustrating the state in which the contact top 31 of the driver guide 30A has been pressed against the workpiece W to move the driver guide 30A to the upper stroke end.

The holding mechanism 70 may be retractable to secure the driving path 300 inside the driver guide 30A for driving the nails 80, while the holding mechanism 70 extends into the driving path 300 inside the driver guide 30A to engage the driven nail 85 before the nail 85 is driven. More specifically, the holding mechanism 70 may engage the bundle resin strip 87 of the driven nail 85 by way of the claw 75 that protrudes into the driving path 300. The holding mechanism 70 may abut the bundle resin strip 87, thereby restricting displacement of the driven nail 85 from the driving position.

Like the driver guide 30 according to the first embodiment described above, the driver guide 30A according to the second embodiment may allow insertion of the driver 15 for driving the driven nail 85 and guiding the driving movement of the driver 15, and also may guide the ejection movement of the driven nail 85 driven by the driver 15. Further, like the driver guide according to the first embodiment described above, the driver guide 30A according to the second embodiment may also function as a contact arm for detecting the press contact state with respect to the workpiece W (object of driving). That is, the leading end (lower end) of the driver guide 30A is also formed as the contact top 31 that is brought into press contact with the workpiece W, and the driver guide 30A is also capable of relative movement with respect to the tool main body 11.

The driver guide 30A according to the second embodiment may have a cutout groove 37 formed in the inner peripheral wall 33 facing the opening 32. The cutout groove 37 may be formed as a recessed groove allowing the claw 75 of the holding mechanism 70 to enter it. Further, the cutout groove 37 may have a length smaller than the movement range in which the driver guide 30A makes relative movement with respect to the tool main body 11. A leading and side wall surface 371 may be formed at the leading end side of the cutout groove 37. The holding mechanism 70 may be supported by the nose case 51 at a position opposed to the cutout groove 37. The holding mechanism 70 may generally include a pivotal support shaft 71 fixedly supported by the nose case 51, a lever member 72 having one and pivotally supported by the pivotal support shaft 71, and an urging spring 77 for urging the lever member 72 to pivot outward toward the cutout groove 37.

The lever member 72 may be supported by the pivotal support shaft 71 so that the other and opposite to the pivotal support shaft 71 can swing outward and inward (toward and away from the cutout groove 37). The claw 75 may be formed on an intermediate portion of an outer surface of the lever member 72 to protrude outward therefrom. As shown in the enlarged view of FIG. 9B, etc., the leading end side of the claw 75 may be formed as a tapered surface portion 751 inclined with respect to the direction in which the driver guide 30A extends, while the base end side of the claw 75 may be formed as an orthogonal surface portion 752 extending orthogonal to the direction in which the driver guide 30A extends. At the other end of this lever member 72, there is provided an abutment protrusion 73 for determining a limit to the outward swinging movement of the lever member 72. This abutment protrusion 73 may abut an abutment restriction portion 78 fixedly supported by the nose case 51. Through the abutment of the abutment protrusion 73 to the abutment restriction portion 78, a maximum swinging limit for the outward swinging of the lever member 72 may be determined. At the maximum limit, the above-mentioned claw 75 of the lever member 72 may enter the cutout groove 37. Thus, the urging spring 77 normally urges the intermediate portion of the lever member 72 such that the other end side of the lever member 72 moves outward toward the cutout groove 37. The lever member 72 may pivot within a plane that is not parallel to the plane along which the bundle resin strip 87 is fed. For example, the lever member 72 may pivot within a plane that is orthogonal to the plane along which the bundle resin strip 87 is fed. In this way, it is possible to avoid interference of the lever member 72 with the driven nail 85.

The holding mechanism 70 constructed as described above acts on the cutout groove 37 as follows: In the state shown in FIGS. 9A and 9B (FIGS. 5A and B) and FIGS. 11A and 11B (FIGS. 10A and 10B), the driver guide 30A is situated at the stroke end on the leading end side of the movement range with respect to the tool main body 11. In this state, the driver guide 30A still has not detected the press contact state with respect to the workpiece W. Thus, the claw 75 of the holding mechanism 70 is in the state in which it has entered the cutout groove 37 of the driver guide 30A. In this case, the claw 75 protrudes into the driving path 300 inside the driver guide 30A, and the orthogonal surface portion 752 of the claw 75 can engage the bundle resin strip 87 of the driven nail 85. For example, the claw 75 may engage grooves or holes (not shown) that may be formed in the bundle resin strip 87 or may engage the lower end of a portion of the bundle resin strap 87 covering the driven nail 85. That is, in the combustion-type driving tool equipped with the driver guide 30A described above, the holding mechanism 70 is equipped with the claw 75. The bundle resin strip 87 may abut the orthogonal surface portion 752 of the claw 75 protruding into the driving path 300, so that the movement of the driven nail 85 can be restricted. As a result, when the driver guide 30A moves from the leading end side toward the base end side or the side of the tool main body 11, it is possible for the claw 75 of the holding mechanism 70 to be engaged with the driven nail 85 (restrict its movement through abutment), so that it is possible to support the last nail 83 before driving in position at the correct driving position inside the driver guide 30A. Further, the engagement of the driven nail 85 by the claw 75 is effected via the bundle resin strip 87 provided to cover the outer peripheral surface of the driven nail 85, so that the driven nail 85 is easy to engage. This may advantageous in supporting the last nail 83 at the determined position.

On the other hand, in the state shown in FIGS. 13A and 13B (FIGS. 12A and 12V) and FIGS. 15A and 15B (FIGS. 14A and 14B), the driver guide 30A is situated at an intermediate position in the movement range with respect to the tool main body 11. In this position, the driver guide 30A still has not detected the press contact state with respect to the workpiece W. As the driver guide 30A moves from the leading end side stroke end to the intermediate position, the leading end side wall surface 371 of the cutout groove 37 may abut the tapered surface portion 751 of the claw 75 of the holding mechanism 70 to cause pivoting movement of the claw 75 from inside the cutout groove 37 toward the outside of the same.

FIGS. 17A and 17B (FIGS. 16A and 16B) show the state where the driver guide 30A has moved to the stroke end on the base end side of the movement range with respect to the tool main body 11. At this time, the driver guide 30A detects the press contact state with respect to the workpiece W. In this state, the claw 75 of the holding mechanism 70 is preferably located completely outside of the cutout groove 37, and in contact with the inner peripheral wall 33 of the driver guide 30A. In this way, when the driver guide 30A has moved to the base end side stroke end of the movement range with respect to the tool main body 11, the holding mechanism 70 detects the press contact state with respect to the workpiece W. Therefore, and, as describe above, the driver 15 is allowed to drive the driven nail 85. Thus, because the claw 75 of the holding mechanism 70 is retracted from the driving path 300 to cause disengagement of the orthogonal surface portion 752 of the holding mechanism 70 from the bundle resin strip 87 of the driven nail 85, the driven nail 85 can be driven to be ejected by the driver 15.

As described above, in the case of the combustion-type driving tool having the driver guide 30A, the holding mechanism 70 may include the claw 75. As a result, when the driver guide 30A has not detected the press contact state with respect to the workpiece W, the claw 75 may protrude into the driving path 300 to be engaged with the bundle resin strip 87 of the driven nail 85. That is, the bundle resin strip 87 of the driven nail 85 abuts the orthogonal surface portion 752 of the claw 75 protruding into the driving path 300, making it possible to restrict the movement of this driven nail 85. As a result, during the movement of the driver guide 30A from the leading end side stroke end toward the base end side stroke end or the tool main body 11 side, the claw 75 of the holding mechanism 70 can restrict the movement of the driven nail 85. Therefore, even the last nail 83 before being driven can be supported at the correct driving position inside the driver guide 30A. Further, the engagement of the driven nail 85 by the claw 75 is effected via the bundle resin strip 87 provided to cover the outer peripheral surface of the driven nail 85, so that the driven nail 85 can be easily engaged, which is advantageous in supporting the last nail 83 at the determined position. As described above, when the driver guide 30A has detected the press contact state with respect to the workpiece W, the claw 75 may be retracted from the driving path 300 to release its engagement with the bundle resin strip 87, making it possible to drive the driven nail 85 by the driver 15.

The above embodiments may be modified in various ways. For example, in the embodiments, a combustion type driving tool was exemplified as a driving tool. However, the above teachings should not be construed restrictively and can be also applicable to any other type of driving tools for driving driven members, such as pneumatic driving tools using high-pressure air for driving nails or the like.

Further, also regarding the driver guide, it is not restricted to the one in which the leading end of the driver guide 30 is formed as the contact top 31 to be brought into press contact with the workplace W. Any other type of driver guides may be used as long as they can move with respect to the tool main body.

Further, the internally exposed member 35 of the first embodiment is equipped with the pressing surface 36 against which the driven nail 85 is pressed by the feeding force applied to the driven nail 85 by the feeding mechanism 65 that feeds the driven nail 85 toward the driving position. However, this should not be construed restrictively. It may be possible to use any other type of internally exposed members as appropriate as long as (a) they are separate members from the driver guide so as not to move in conjunction with the relative movement of the driver guide with respect to the tool main body, and (b) they have a pressing surface against which the driven members (such as nails) are pressed by the feeding force for feeding the driven members toward the driving position.

What is claimed is:

1. A driving tool comprising:

a tool body;

a driver configured to drive a driven member;

a driver guide configured to guide the driver together with the driven member, the driver guide being movable with respect to the tool body; and a driven member holding mechanism configured to hold the driven member at a driving position inside the driver guide until the driven member is driven by the driver and such holding of the driven member occurring independently of a movement of the driver guide with respect to the tool body, wherein:

the driven member holding mechanism comprises an internally exposed member exposed inside the driver guide;

the internally exposed member is a separate member from the driver guide and does not move in conjunction with the movement of the driver guide with respect to the tool body;

the internally exposed member includes a pressing surface against which the driven member is pressed by a feeding force that feeds the driven member toward the driving position; and the driven member pressed against the pressing surface is held at the driving position until the driven member is driven by the driver and such holding of the driven member occurring independently of the movement of the driver guide with respect to the tool body.

2. The driving tool according to claim 1, wherein the driver guide has an opening through which the pressing surface is exposed to inside of the driver guide.

3. The driving tool according to claim 1, further comprising:

a plurality of driven members bundled together by a bundle resin strip, so that outer circumferential surfaces of the driven members are covered by the bundle resin strip; and wherein the driven member is pressed against the pressing surface via the bundle resin strip.

4. A driving comprising:

a tool body;

a driver configured to drive a driven member;

a driver guide configured to guide the driver together with the driven member, the driver guide being movable with respect to the tool body; and a driven member holding mechanism configured to hold the driven member at a driving position inside the driver guide until the driven member is driven by the driver and such holding of the driven member occurring independently of a movement of the driver guide with respect to tool body, wherein:

the driven member holding mechanism comprises an engaging mechanism having an engaging member which is movable into and out of a driving passage defined in the driver guide;

when the driver is moved to drive the driven member, the engaging member is positioned outside of the driving passage; and when the driver is not moved to drive the driven member, the engaging member is positioned within the driving passage to engage the driven member.

5. The driving tool according to claim 4, further comprising:

a plurality of driven members bundled together by a bundle resin strip, so that outer circumferential surfaces of the driven members are covered by the bundle resin strip; and wherein the engaging member comprises a claw member configured to engage the bundle resin strip.

6. A driving tool comprising:

a tool body;

a driver configured to drive a driven member;

a driver guide configured to guide the driver together with the driven member, the driver guide being movable with respect to the tool body; and a driven member holding mechanism configured to hold the driven member at a driving position inside the driver guide until the driven member is driven by the driver and such holding of the driven member occurring independently of a movement of the driver guide with respect to the tool body, wherein:

the driver guide has an end portion configured as a contact top for contacting an object into which the driven member is driven; and the driver guide moves with respect to the tool body as the contact top is pressed against the object.

7. The driving tool according to claim 6, wherein;

the driving tool is a combustion-type driving tool having a combustion chamber provided in the tool body;

the combustion chamber closes in response to a pressing movement of the contact top against the object.

8. A driving tool comprising:

a tool body;

a magazine connected to the tool body, wherein a plurality of driven members bundled together by a bundle resin strip are loaded in the magazine;

a driver configured to drive one by one the driven members of the bundle resin strip;

a driver guide configured to guide the driver together with a driven member of the plurality of driven members that is to be driven, the driver guide being movable with respect to the tool body; and a driven member holding mechanism configured to hold the driven member to be driven at a driving position inside the driver guide until the driven member is driven by the driver, wherein the driven member holding mechanism includes an internally exposed member fixed in position relative to the tool body, at least a part of the internally exposed member being exposed to an inside of the driver guide.

* * * * *